US012110160B2

(12) United States Patent
Piazzi et al.

(10) Patent No.: US 12,110,160 B2
(45) Date of Patent: Oct. 8, 2024

(54) DISSOLVABLE TEXTILE PACKAGE ENCLOSING WASH ENABLED SELF-UNFOLDING TEXTILES AND CORRESPONDING METHODS

(71) Applicant: Medline Industries, LP, Northfield, IL (US)

(72) Inventors: John Piazzi, Chicago, IL (US); Hannah Parey, Chicago, IL (US); Rachel Sinde, Des Plaines, IL (US); Andrew Pajak, Oak Creek, WI (US)

(73) Assignee: Medline Industries LP, Northfield, IL (US)

( * ) Notice: Subject to any disclaimer, the term of this patent is extended or adjusted under 35 U.S.C. 154(b) by 0 days.

(21) Appl. No.: 18/097,445

(22) Filed: Jan. 16, 2023

(65) Prior Publication Data

US 2024/0239579 A1 Jul. 18, 2024

(51) Int. Cl.
*B65D 65/46* (2006.01)
*B65D 85/07* (2017.01)

(52) U.S. Cl.
CPC ..... *B65D 65/46* (2013.01); *B65D 85/07* (2018.01); *B65D 2565/381* (2013.01)

(58) Field of Classification Search
CPC ... B65D 65/46; B65D 85/07; B65D 2565/381
USPC ..... 206/494
See application file for complete search history.

(56) References Cited

U.S. PATENT DOCUMENTS

| | | | | |
|---|---|---|---|---|
| 3,279,511 | A * | 10/1966 | Griffin, Jr. | B65D 31/00 383/107 |
| 3,322,674 | A | 5/1967 | Jack | |
| 3,398,826 | A * | 8/1968 | Clancy | A47K 10/16 206/484 |
| 3,777,749 | A | 12/1973 | Collins | |
| 4,544,693 | A | 10/1985 | Surgant | |
| 4,627,427 | A | 12/1986 | Acro | |
| 5,004,556 | A | 4/1991 | Julemont | |
| 5,190,694 | A * | 3/1993 | Osberghaus | B01D 19/04 206/494 |
| 6,776,287 | B1 | 8/2004 | Hinde | |
| 7,083,047 | B2 | 8/2006 | Bone | |
| 7,159,265 | B2 * | 1/2007 | Soller | A47K 11/10 15/104.93 |
| 8,859,486 | B2 | 10/2014 | Petrovicova | |
| 8,940,676 | B2 | 1/2015 | Catlin | |
| D796,036 | S | 8/2017 | Ren | |
| 9,757,282 | B2 | 9/2017 | Ren et al. | |
| 10,039,610 | B2 | 8/2018 | Allen | |
| 10,188,475 | B2 | 1/2019 | Chua et al. | |

(Continued)

OTHER PUBLICATIONS

Carranza, et al., "Application as Filed", U.S. Appl. No. 29/748,803, filed Sep. 1, 2020; Specification and Figures as Filed.

*Primary Examiner* — Bryon P Gehman
(74) *Attorney, Agent, or Firm* — Philip H. Burrus, IV

(57) ABSTRACT

A kit includes a plurality of textile items arranged in a stack and a dissolvable package enclosing the plurality of textile items. The textile items can be washcloths, bath blankets, flat sheets, or other types of textile items. For larger textile items, a wash enabled self-unfolding fold can be applied to each textile item so that it automatically unfolds into wash water when the dissolvable package dissolves.

20 Claims, 17 Drawing Sheets

(56) References Cited

U.S. PATENT DOCUMENTS

| | | | | |
|---|---|---|---|---|
| 10,619,042 | B2 | 4/2020 | Labeque | |
| 10,793,813 | B2 * | 10/2020 | Stafford, III | B65D 65/46 |
| 2008/0263797 | A1 * | 10/2008 | Berger | B65D 65/46 15/104.93 |
| 2011/0127270 | A1 | 6/2011 | Hartman et al. | |
| 2016/0317397 | A1 | 11/2016 | Wenz | |
| 2022/0061945 | A1 | 3/2022 | Carranza et al. | |

* cited by examiner

DISSOLVABLE TEXTILE PACKAGE ENCLOSING WASH ENABLED SELF-UNFOLDING TEXTILES AND CORRESPONDING METHODS

BACKGROUND

Technical Field

This disclosure relates generally to textiles, and more particularly to textiles bound in packaging.

Background Art

Textile products, examples of which include sheets, blankets, towels, and washcloths, when sold for commercial and institutional uses, are generally shipped to the industrial or commercial customer in a packaged configuration. Illustrating by example, these textiles may be folded, placed into plastic bags, and then stacked in cardboard boxes.

Industrial laundries are frequently required to launder all newly purchased textiles prior to use or shipment to others. Indeed, many healthcare facilities and industrial operations use industrial laundries to launder such textiles. Unpackaging these plastic wrapped, stacked, cardboard enclosed textiles is a time consuming and cumbersome process, as each sheet, blanket, towel, or washcloth must be manipulated by hand to be washed. This is true regardless of whether the textiles are washed in full or half batches. It would be advantageous to have improved products and processes that reduce the time and effort required to launder new textiles.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
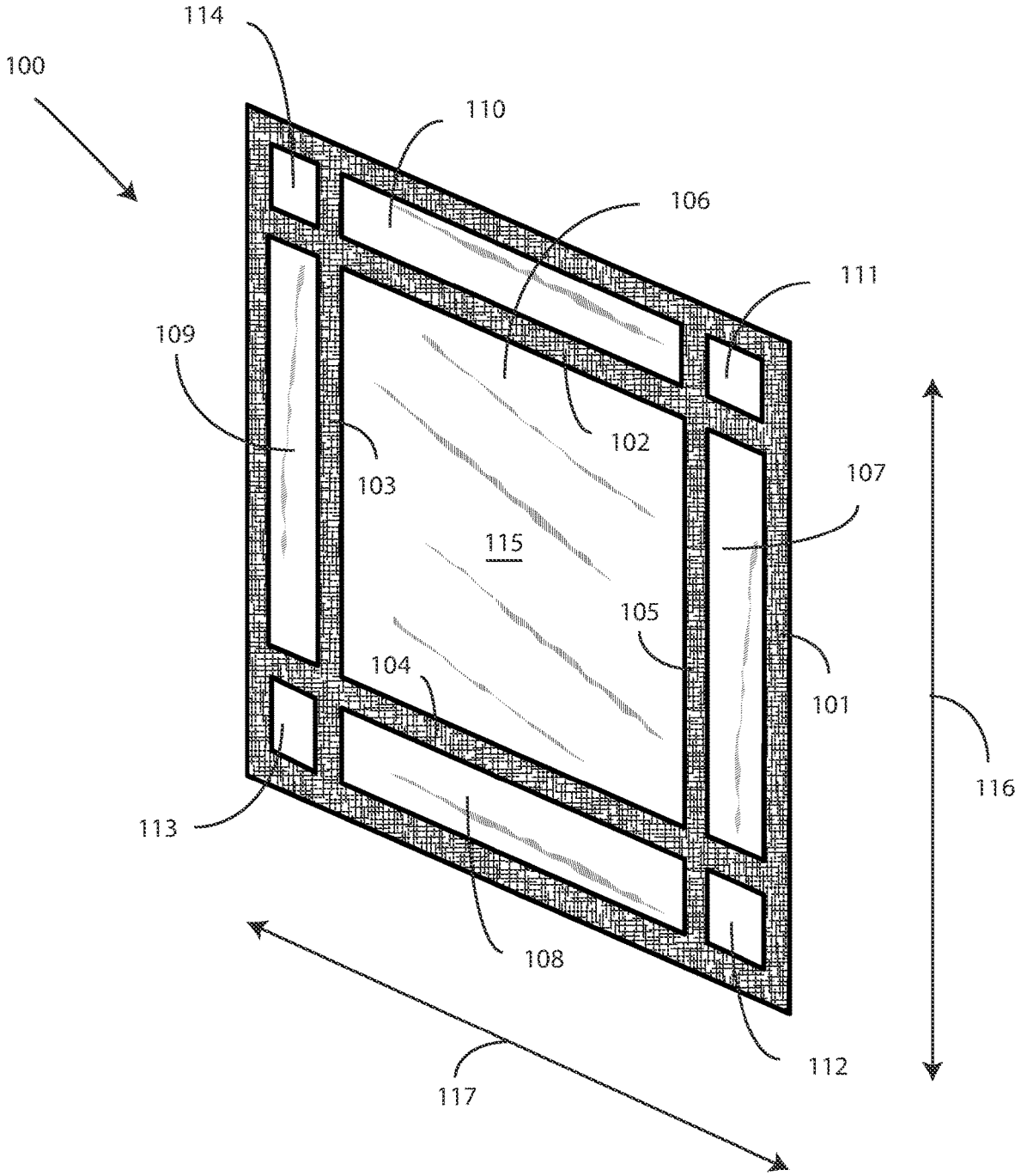
FIG. 1 illustrates one explanatory textile in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Before describing in detail embodiments that are in accordance with the present disclosure, it should be observed that the embodiments reside primarily in combinations of method steps and apparatus components related to folding textiles so that they will self-unfold when laundered and packaging those folded textiles in a dissolvable packaging to form a kit so that the textiles can be laundered simply by placing the kit in the laundry. Alternate implementations are included, and it will be clear that functions may be executed out of order from that shown or discussed, including substantially concurrently or in reverse order, depending on the functionality involved.

Accordingly, the apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, it is expected that one of ordinary skill, notwithstanding possibly significant effort and many design choices motivated by, for example, available time, current technology, and economic considerations, when guided by the concepts and principles disclosed herein will be readily capable of performing such method steps for making and using kits, packaged kits, and textile items in accordance with embodiments of the disclosure, in any order, with minimal experimentation.

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

The terms "substantially," "essentially," "approximately," "about," or any other version thereof, are defined as being close to as understood by one of ordinary skill in the art, and in one non-limiting embodiment the term is defined to be within ten percent, in another embodiment within five percent, in another embodiment within one percent and in another embodiment within one-half percent. Also, reference designators shown herein in parenthesis indicate components shown in a figure other than the one in discussion. For example, talking about a device (10) while discussing figure A would refer to an element, 10, shown in figure other than figure A.

In prior art textile packaging, a textile product is typically folded in half, and perhaps half again, placed into a polyethylene bag for protection, and stacked in corrugated boxes. Since most all industrial laundries are required to launder the textiles prior to shipment to customers, a technician is required to open the boxes, remove the polyethylene bagged textiles, open the polyethylene bag, remove each textile item one by one, shake each textile item out to unfold the folds, and then loosely place the textile item in a bin (sometimes on a one-off basis) so they can be loaded into a washing machine. With prior art systems, this is the only technique available to effectively wash each textile item.

As one can imagine, this process is incredibly tedious, time consuming, cumbersome, and expensive. Moreover, it is stressful on the technician as numerous reaching, shaking, opening, lifting, and placing operations are required just to get the textile items "in the laundry."

What's more, the process generates enormous amounts of waste. This waste accumulates as countless plastic bags are discarded when the textiles stored therein are removed. These countless single-use plastic bags ultimately get sent to the landfill once the process is completed. Studies have shown that it can take one thousand years or more for a plastic bag to degrade in a landfill. Moreover, many plastics ultimately do not completely degrade in nature. To the contrary, they frequently photodegrade into microplastics that absorb toxins and contribute to environmental pollution.

Embodiments of the disclosure provide a solution to these, and other problems associated with prior art textile products. In one or more embodiments, a method packages textile items with a unique folding method that self-releases and "self-unfolds" when being laundered. After this special "wash enabled self-unfolding" folding technique is applied to the textile items, they are placed into a dissolvable package. That the wash enabled self-unfolding textiles are placed in a dissolvable package dramatically reduces the time, effort, labor, and stress of laundering textiles due to the fact that there is no longer either a requirement to unpack or to shake out textile items. Additionally, there is no longer a need to handle textile items one by one. Instead, an entire kit comprising a dissolvable package and one or more wash enabled self-unfolding textile items can simply be placed into a laundry machine as a whole. When washed, the dissolvable package dissolves, and the wash enabled self-unfolding textile items self-unfold.

In one or more embodiments, the wash enabled self-unfolding folding method allows each textile item to "open up" in the wash to be effectively cleaned and sanitized. In effect, the wash enabled self-unfolding folding technique allows for bypassing the unfolding or "shake out" step of the prior art laundering process. Stacking the wash enabled self-unfolding textile items in the dissolvable package allows for easy management of the kits during laundering and transport. In one or more embodiments, the dissolvable packages are designed to dissolve at initial water temperatures when entering the washing machines.

In one or more embodiments, a kit includes a plurality of textile items arranged in a stack and a dissolvable package enclosing the plurality of textile items. While the textile items can take any of a number of forms, for illustrative purposes washcloths, bath blankets, and flat sheets will be discussed as explanatory examples. However, many other examples of textiles will be obvious to those of ordinary skill in the art having the benefit of this disclosure. For larger textile items, a wash enabled self-unfolding fold can be applied to each textile item so that it automatically unfolds into wash water when the dissolvable package dissolves. The kits can be arranged in a kit arrangement that is packaged as a bale.

In one or more embodiments, textile items are either stacked or folded with a wash enabled self-unfolding fold and then stacked in a dissolvable package. Illustrating by example, for smaller textile items, such as washcloths, these textile items can simply be stacked within a dissolvable package. For larger items, such as towels or "bath blankets" or sheets, a wash enabled self-unfolding fold can be applied to the textile items before stacking in the dissolvable package.

The dissolvable package can then be sealed around the textile items. In one or more embodiments, the dissolvable package is adhesively sealed around the textile items, although other sealing methods will be obvious to those of ordinary skill in the art having the benefit of this disclosure.

When sealed, the dissolvable package enclosing the textile items, with or without the wash enabled self-unfolding folds, forms a "kit." The kit can then be arranged into a kit arrangement, which is packaged to form a "bale" or packaged kit arrangement. When received by the laundry, the bale is simply opened, and the kits are placed into the washing machine. The dissolvable package dissolves quickly and the agitation of the washing machine causes the wash enabled self-unfolding folds to unfold.

Each textile item is then cleaned, and laundered, all without the need of any of the removal of polyethylene bagged textiles, opening of the polyethylene bags, removal of each textile item one by one, shaking each textile item out to unfold the folds, and loose placement of the textile items in a bin (sometimes on a one-off basis) for loading in a washing machine that is required by the prior art. Advantageously, embodiments of the disclosure save time, labor, wear on workers, and cost. They additionally reduce the amount of waste associated with receiving new textile items. Other advantages will be described below. Still others will be obvious to those of ordinary skill in the art having the benefit of this disclosure.

The above summary of the embodiments of the disclosure is not intended to represent each embodiment or every aspect of the various embodiments. The detailed description and figures will describe many of the embodiments and aspects of the disclosure in further detail.

Turning now to FIG. 1, illustrated therein is one explanatory textile item in accordance with one or more embodiments of the disclosure. The textile item of FIG. 1 is shown illustratively as a washcloth 100. However, embodiments of the disclosure are not so limited. As will be described in later figures, other examples of textile items configured in accordance with embodiments of the disclosure include bath blankets and flat sheets. Still other textile items will be obvious to those of ordinary skill in the art having the benefit of this disclosure.

As shown, the washcloth 100 defines a two-sided sheet of textile material 115. The two-sided sheet of textile material 115 can be manufactured from a textile material 115 that is woven or knit. The textile material 115 can further be manufactured with natural stretch capabilities. Said differently, it can be "stretchy" with the inclusion of elastic materials in the weave. In other embodiments, the textile material 115 can be a standard weave without stretch capabilities.

In one or more embodiments, the textile material 115 is woven. For example, the textile material may include a one-ply weave, a two-ply weave, and so forth. The weave can include warps and wefts. The warps are elements of the weave that run vertically in the view of FIG. 1, while the wefts run generally horizontally (which would be a bit downward and to the right in FIG. 1 due to the perspective view). Note that while the terms "warps" and "wefts" are used illustratively to describe the weave, those of ordinary skill in the art having the benefit of this disclosure will note that alternate terms, such as "warp threads," or "warp yarns" can be substituted for "warps." Similarly, "weft fill" or "weft threads" can be substituted for "wefts." In one or more embodiments, the weave of the textile material 115 is a taffeta weave. A "taffeta" weave is a style of weave where the threads forming the wefts and warps intertwine alternatively to produce the checkerboard effect.

The warps and wefts can include synthetic threads, organic threads, or combinations thereof. Illustrating by example, in one embodiment the warps and wefts comprise polyester. In another embodiment, the warps and wefts comprise cotton. In another embodiment, the warps and wefts comprise wool. Of course, combinations could be used as well. For instance, in another embodiment the warps and wefts can comprise a combination of cotton and polyester.

Elastomeric materials may be interlaced with the weave to give the item a "stretchy" characteristic. Other examples of materials for the warps and wefts will be obvious to those of ordinary skill in the art having the benefit of this disclosure.

As shown in FIG. 1, the washcloth 100 is substantially rectangular (and optionally square) in shape and is defined by a length 116 and a width 117. In one embodiment, the length 116 is about twelve inches, while the width 117 is also about twelve inches. It should be noted that the width 117 and length 116 can take other dimensions as well.

A border can be placed around the perimeter of the washcloth 100 in one or more embodiments. Illustrating by example, the border can provide reinforcement to the washcloth 100, as well as maintaining a smoothness of shape for the washcloth 100. In one or more embodiments, the border (where included) is a cloth border. In other embodiments, the border is manufactured from non-cloth reinforcing materials.

Additionally, stitching 101 or other textile manufacturing processes can be applied to provide an ornamental appearance to the washcloth 100 in one or more embodiments. In the illustrative embodiment of FIG. 1, the stitching 101 creates one or more cross bars 102,103,104,105 that define a central panel 106 surrounded by four elongated panels 107,108,109,110 and four corner squares 111,112,113,114.

While the cross bars 102,103,104,105 can be used to create an ornamental appearance, they can have functional uses as well. Illustrating by example, in one or more embodiments the cross bars 102,103,104,105 can comprise scrubbing materials such as loofah or plastic scrubbers. In other embodiments, the cross bars 102,103,104,105 can comprise small soap retaining pockets or other features that make the washcloth 100 more useful in personal hygiene operations.

In one or more embodiments, the central panel 106, four elongated panels 107,108,109,110, and four corner squares 111,112,113,114 have a different "hand" or feel than do the cross bars 102,103,104,105. For example, in one or more embodiments the cross bars 102,103,104,105 have a firmer hand, while the central panel 106, four elongated panels 107,108,109,110, and four corner squares 111,112,113,114 have a softer hand.

In the illustrative embodiment of FIG. 1, the washcloth 100 is substantially rectangular. In this illustrative embodiment, the washcloth 100 is actually square. Other shapes suitable for washcloths 100 configured in accordance with embodiments of the disclosure will be obvious to those of ordinary skill in the art having the benefit of this disclosure. For example, in other embodiments the washcloth 100 is ovular. Additionally, while the washcloth 100 of FIG. 1 is a continuous sheet, in other embodiments the washcloth 100 will define one or more apertures that allow a user to more securely hold the washcloth 100 in their hand.

Figure 2:
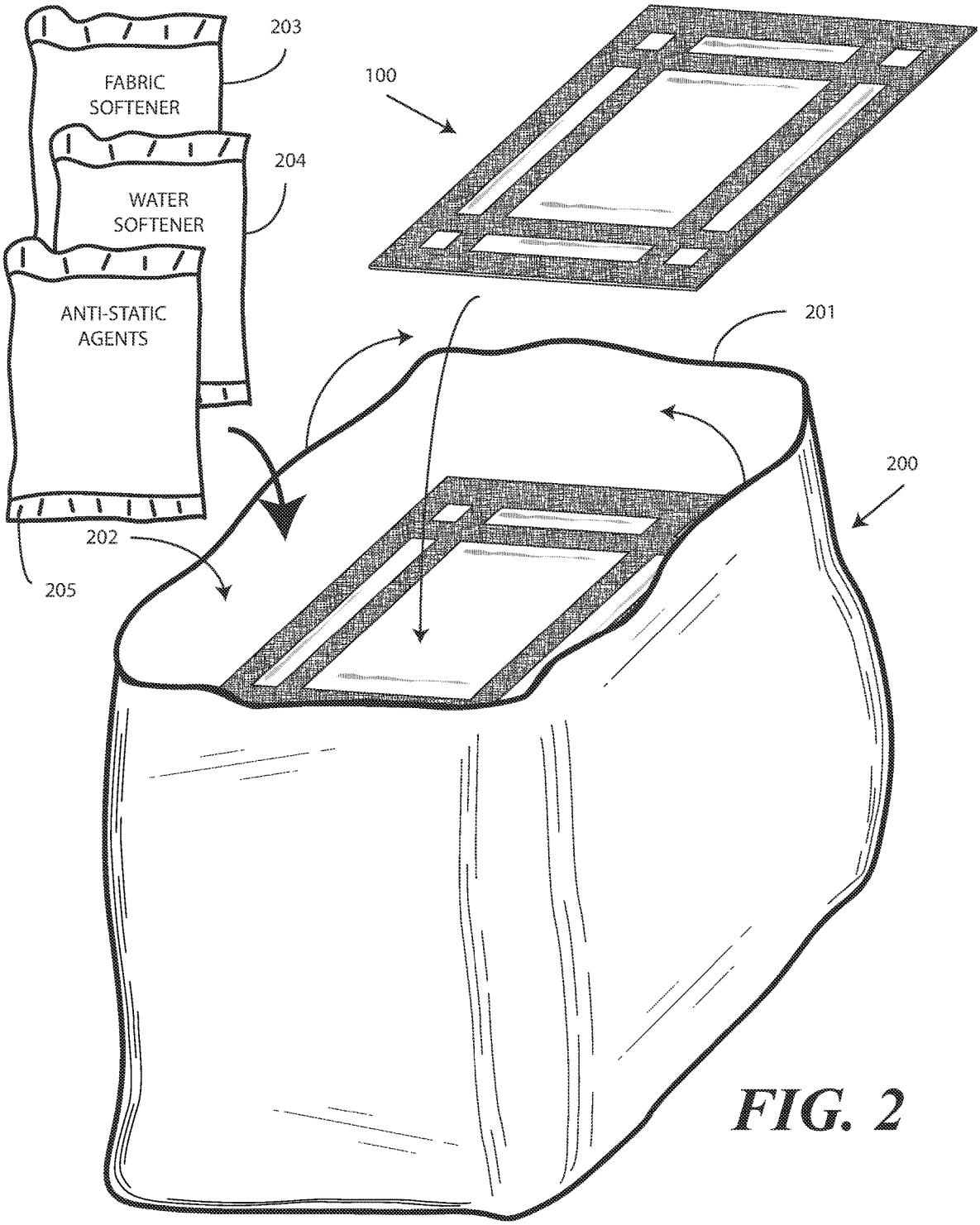
FIG. 2 illustrates one explanatory dissolvable package receiving textiles in accordance with one or more embodiments of the disclosure.

Turning now to FIG. 2, illustrated therein is the explanatory washcloth 100 of FIG. 1 being placed into dissolvable package 200 configured in accordance with embodiments of the disclosure. Said differently, FIG. 2 depicts the dissolvable package 200 receiving multiple washcloths, each configured in the form of the washcloth 100 of FIG. 1.

In one or more embodiments, the dissolvable package 200 is manufactured from a film layer that dissolves when it contacts water. A variety of materials can be used to construct the dissolvable package 200 in accordance with embodiments of the disclosure. Illustrating by example, the dissolvable package 200 can be manufactured from a film that includes one or more of polypropylene, polyvinyl alcohol, glycerin, and/or starch.

Illustrating by example, in one or more embodiments the dissolvable package 200 is manufactured from a film of polyvinyl alcohol. Since polyvinyl alcohol is soluble in water, in one or more embodiments when the film defining the dissolvable package 200 is manufactured from polyvinyl alcohol the water will break down and dissolve the film of polyvinyl alcohol defining the sidewalls of the dissolvable package 200, thereby releasing the washcloths 100 situated therein. When this water is within the confines of a laundering machine, this dissolution of the sidewalls of the dissolvable package 200 allows the washcloths 100 to enter the wash water for proper laundering.

The film defining the dissolvable package 200 can be manufactured from other dissolvable materials as well. Illustrating by example, in another embodiment the film is manufactured from polyvinylpyrrolidone. In another embodiment, the dissolvable package 200 is manufactured from a film of polyethylene glycol and carboxymethyl cellulose. In still other embodiments, the dissolvable package 200 is manufactured from polylactic-co-glycolic acid. Other examples of dissolvable materials suitable for manufacturing the dissolvable package 200 will be obvious to those of ordinary skill in the art having the benefit of this disclosure.

In one or more embodiments, the film defining the sidewalls of the dissolvable package 200 has a minimum thickness to prevent incidental contact with moisture from destroying the dissolvable package 200 and releasing the washcloths 100. In one or more embodiments, so as to have a texture like thick plastic, the sidewalls of the dissolvable package 200 are at least 0.1 millimeters in thickness to ensure that the washcloths 100 are retained within the dissolvable package 200 until the dissolvable package 200 contacts the water of a laundering machine.

While the sidewalls of the dissolvable package 200 comprise a single film layer in the illustrative embodiment of FIG. 2, in other embodiments the sidewalls of the dissolvable package 200 will comprise multiple layers. Each layer of a multi-layer sidewall can be constructed from a dissolvable material, and the materials of the various layers can be manufactured from the same dissolvable material or different dissolvable materials.

In one or more embodiments, only washcloths 100 are placed within the dissolvable package 200. However, embodiments of the disclosure contemplate that other items can be placed within the dissolvable package 200 along with the washcloths 100 to make the laundering process more efficient. Illustrating by example, in one or more embodiments a package 203 of fabric softener is placed within the dissolvable package 200 along with the washcloths 100. In another embodiment, a package 204 of water softener is placed within the dissolvable package 200 along with the washcloths 100. In still another embodiment, a package 205 of anti-static additives is placed within the dissolvable package 200 along with the washcloths 100. In still other embodiments, anionic surfactants (pre-detergents) that repel other parts of the textile itself so that the textiles more readily unfold can be included as well, as can be cationic sufactants that work in a similar manner to repel similar charges to assist the textiles in unfolding. Of course, these packages 203,204,205 could be placed in the dissolvable package 200 in any combination as well.

In addition to these packages 203,204,205, packages of other materials could be included in the dissolvable package 200 along with the washcloths 100 as well. Examples include packages of dye neutralizers, fabric expanders, antimicrobial agents, optical brighteners, de-linters, moisture wickers, absorbency enhancers, and wrinkle reducers. These packages can be dissolvable as well and can be included in any combination in the dissolvable package 200.

Where included these packages 203,204,205 can be constructed from dissolvable films as well. Accordingly, when the dissolvable package 200 dissolves in the laundry, the package(s) 203,204,205 can dissolve as well, thereby releasing their fabric softening, water softening, and/or anti-static materials (or combinations thereof) into the wash water with the washcloths 100.

Figure 3:
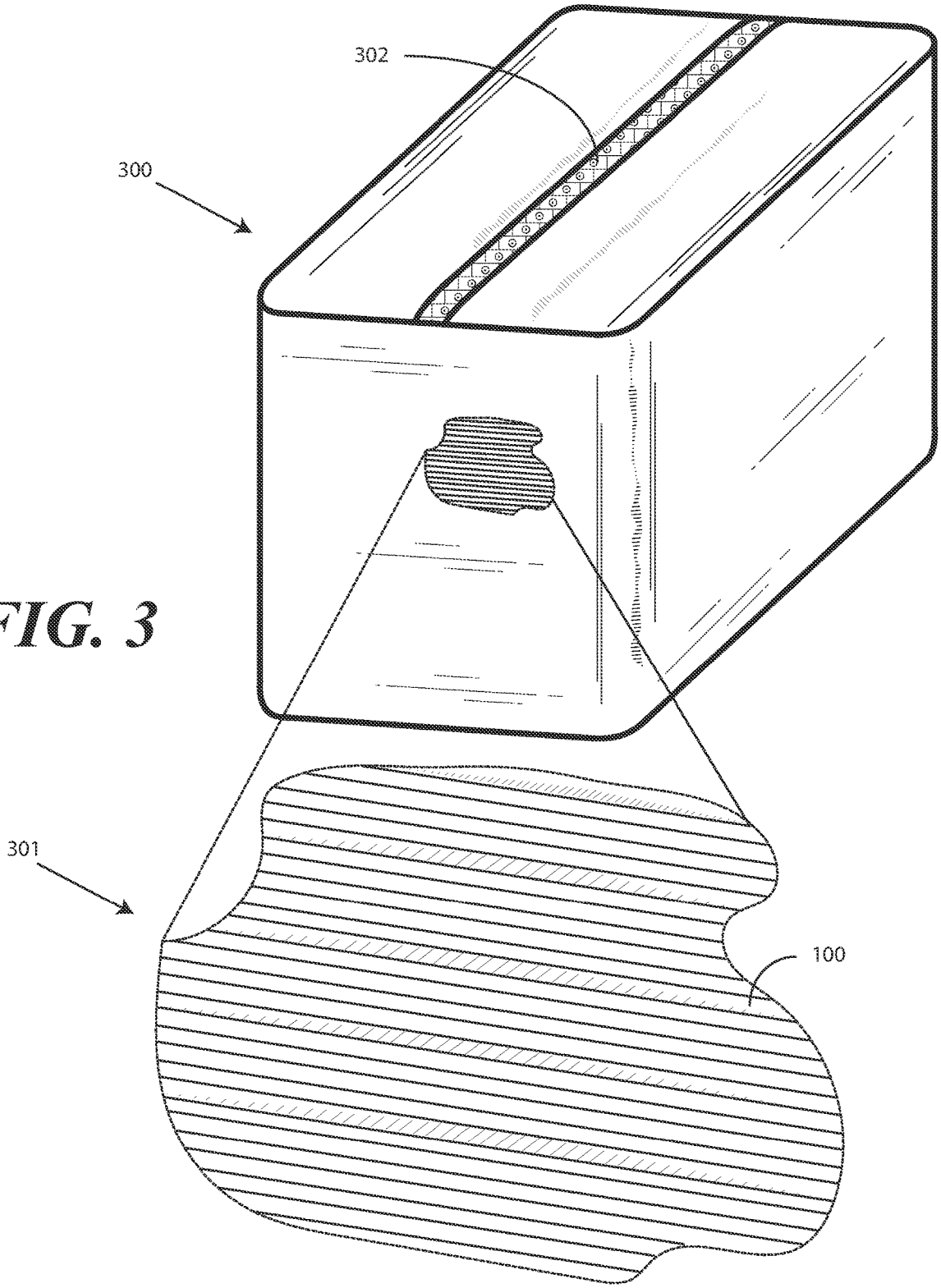
FIG. 3 illustrates one explanatory kit in accordance with one or more embodiments of the disclosure.

Once the washcloths 100 are all placed within the dissolvable package 200, the side edges 201 of the opening 202 defined by the sidewalls of the dissolvable package 200 can be closed. The opening 202 of the dissolvable package 200 can then be sealed to form a kit. Turning now to FIG. 3, illustrated therein is one explanatory kit 300 in accordance with one or more embodiments of the disclosure.

As shown, the opening (202) has been secured closed by a seal 302. In one or more embodiments, the seal 302 comprises an adhesive seal. In other embodiments, the opening (202) can be closed by a seal 302 created by sonic welding, thermal welding, or a mechanical fastener. Other examples of seals 302 will be obvious to those of ordinary skill in the art having the benefit of this disclosure.

As shown in the cutaway view 301, in one or more embodiments the kit 300 encloses a stack of washcloths 100. Illustrating by example, in one or more embodiments the kit 300 encloses one hundred and twenty washcloths 100 arranged in a single stack. Other arrangements will be obvious to those of ordinary skill in the art having the benefit of this disclosure.

Figure 4:
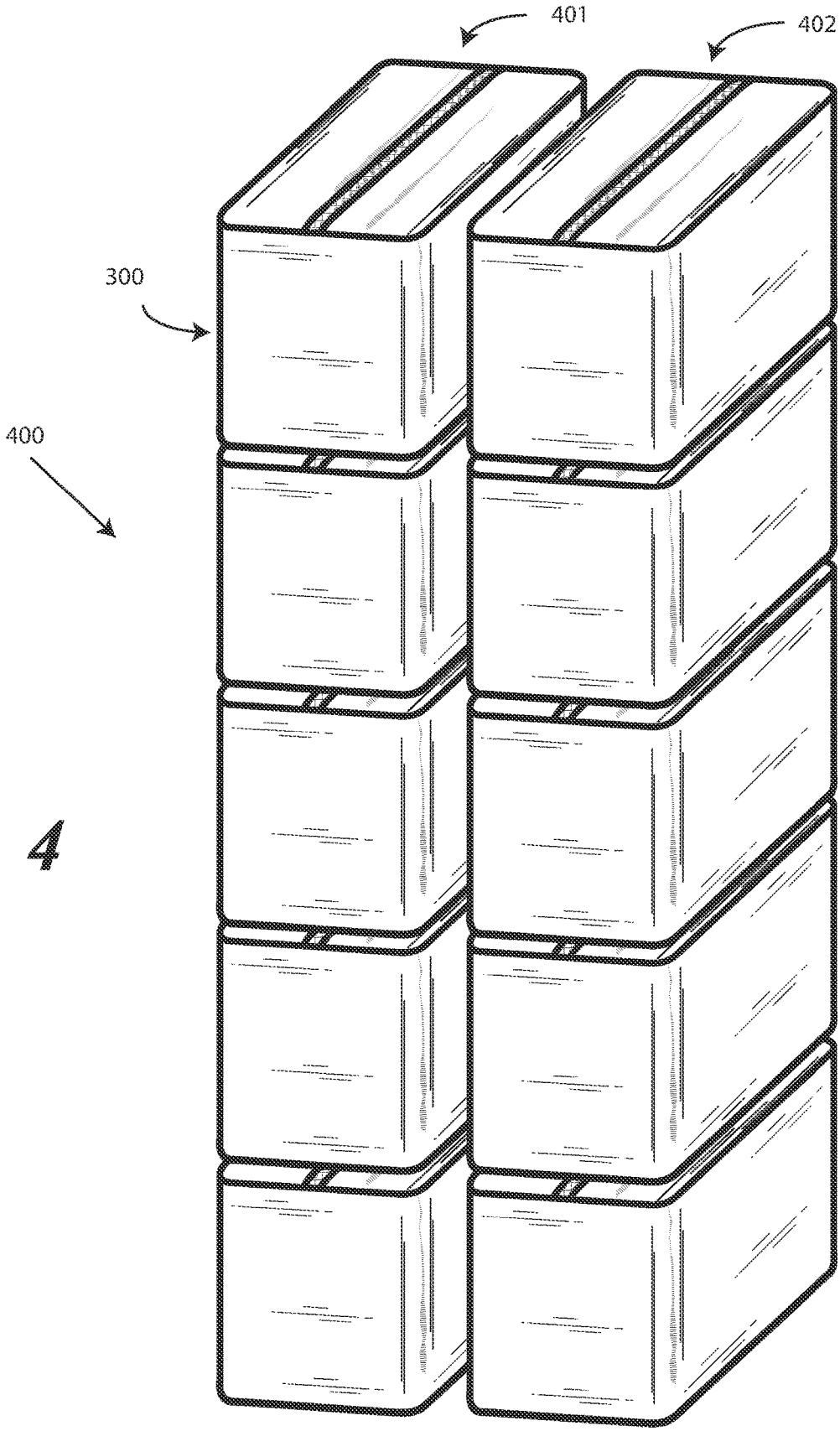
FIG. 4 illustrates one explanatory kit arrangement in accordance with one or more embodiments of the disclosure.

Turning now to FIG. 4, once each kit 300 is constructed, a plurality of kits can be arranged in a kit arrangement 400. In this illustrative embodiment, the kit arrangement 400 comprises two columns 401,402 of five kits. Embodiments of the disclosure contemplate that governmental and other regulations may limit the number of kits that can be placed in a single package. Accordingly, the kit arrangement 400 of FIG. 4 is intended to meet such regulations by placing twelve or fewer kits in a single package.

Figure 5:
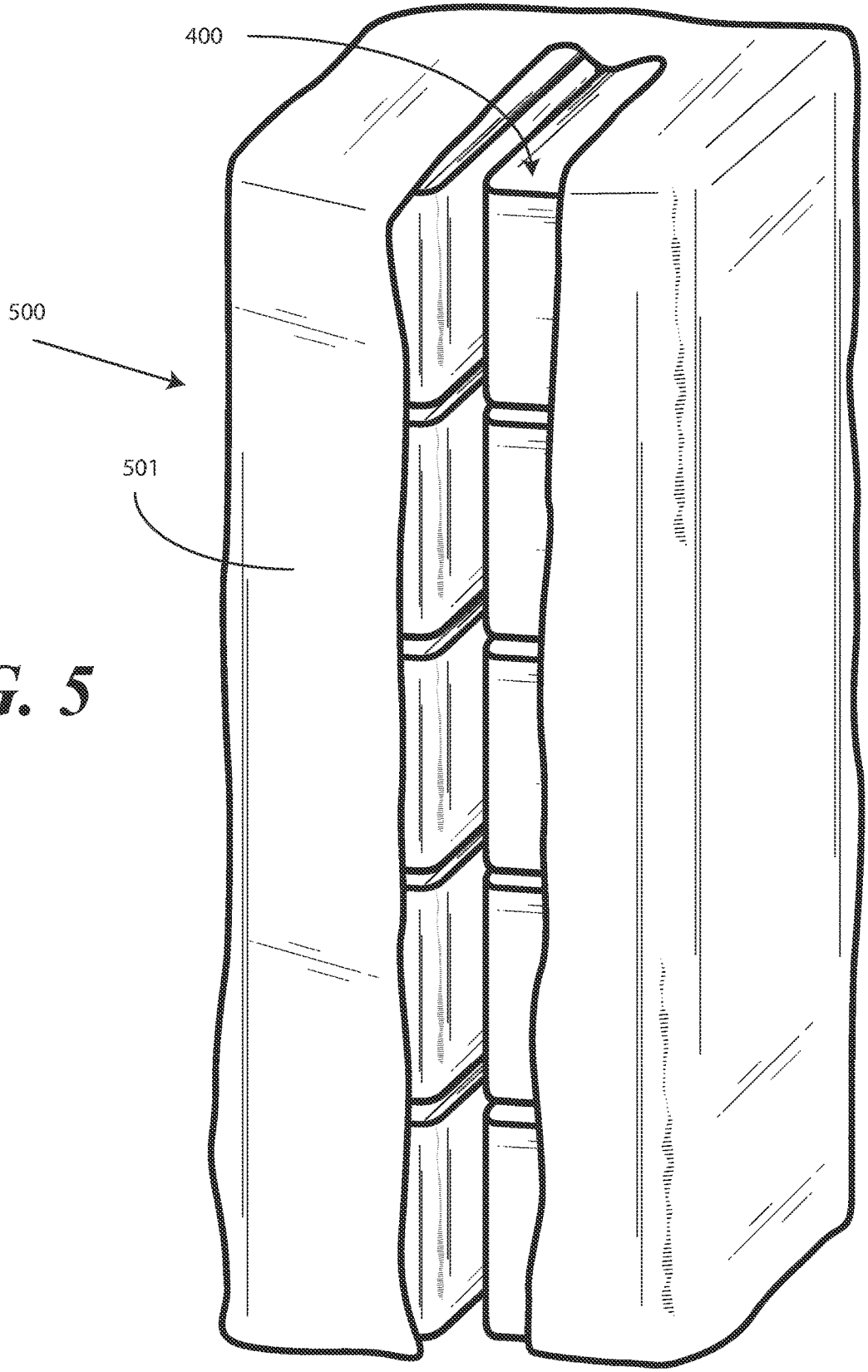
FIG. 5 illustrates one explanatory partially packaged kit arrangement in accordance with one or more embodiments of the disclosure.

Once the kit arrangement 400 is made, it can be packaged in a "bale" in one or more embodiments. Turning now to FIG. 5, illustrated therein is a partially packaged kit arrangement 500 that defines the precursor step to forming a bale.

As shown, an outer packaging material 501 has been placed about the kit arrangement 400 of FIG. 4. In one or more embodiments, this packaging material is a non-dissolvable material, one example of which is a thermoplastic material. However, the outer packaging material 501 can take other forms as well. In one or more embodiments, the outer packaging material 501 comprises a corrugated box. In other embodiments, the outer packaging material 501 comprises a reusable box. In still other embodiments, the outer packaging material 501 is a dissolvable film. In still other embodiments, the outer packaging material 501 comprises an organic, biodegradable material. Other examples of outer packaging materials 501 will be obvious to those of ordinary skill in the art having the benefit of this disclosure.

Figure 6:
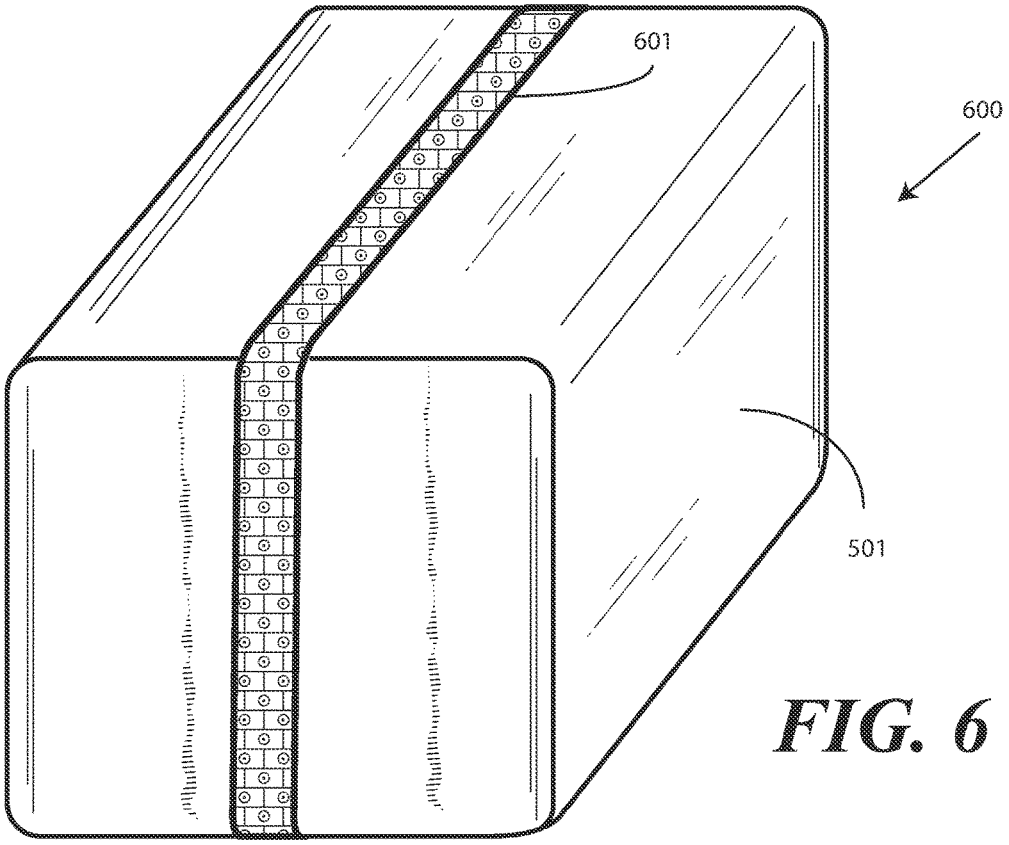
FIG. 6 illustrates one explanatory packaged kit arrangement in accordance with one or more embodiments of the disclosure.

Turning now to FIG. 6, once the outer packaging material 501 has been placed around the kit arrangement 400, the outer packaging material 501 can be sealed with a seal 601 to define a packaged kit arrangement or "bale" 600. In one or more embodiments, the seal 601 comprises an adhesive seal. However, in other embodiments the seal 601 is formed by a mechanical fastener, ultrasonic welding, or thermal welding. In still other embodiments, the seal 601 can be formed by a hood closure attached to the dissolvable package. In other embodiments, the seal 601 can be created by compression or vacuum sealing.

In still other embodiments, there will be no seal 601. Instead, the outer packaging material 501 can simply be wrapped around the kit arrangement 400 with open ends. Alternatively, the outer packaging material 501 can be tied with string. The string could be manufactured from a dissolvable material. In still other embodiments, the outer packaging material 501 itself can be tied around the kit arrangement 400. In other embodiments, the outer packaging material can be tied shut with a washable product, examples of which include sheets, pillowcases, towels, and napkins. Other examples of seals 601 and/or how to close the outer packaging material 501 will be obvious to those of ordinary skill in the art having the benefit of this disclosure.

This bale 600 can then be shipped to a laundry facility for laundering. The bale 600 solves problems associated with prior art textile item packaging systems. Specifically, the placement of washcloths (100) in a dissolvable package (200) dramatically reduces the time, effort, labor, and stress of laundering the washcloths (100). This is true because there is no requirement to either unpack the washcloths (100) from the dissolvable package (200) or to shake them out one-by-one when placing them in the laundry machine. Instead, the seal 601 of the outer packaging material 501 is simply opened. Each kit (300) can then be retrieved and simply be placed into a laundry machine as a whole. When washed, the dissolvable package (200) dissolves and the wash with the washcloths (100) then entering the wash water. Advantageously, stacking the washcloths (100) in the dissolvable package (200) allows for easy management of the kits (300) during laundering and transport. In one or more embodiments, the dissolvable package (200) is designed to dissolve at initial water temperatures when entering the washing machines.

Figure 7:
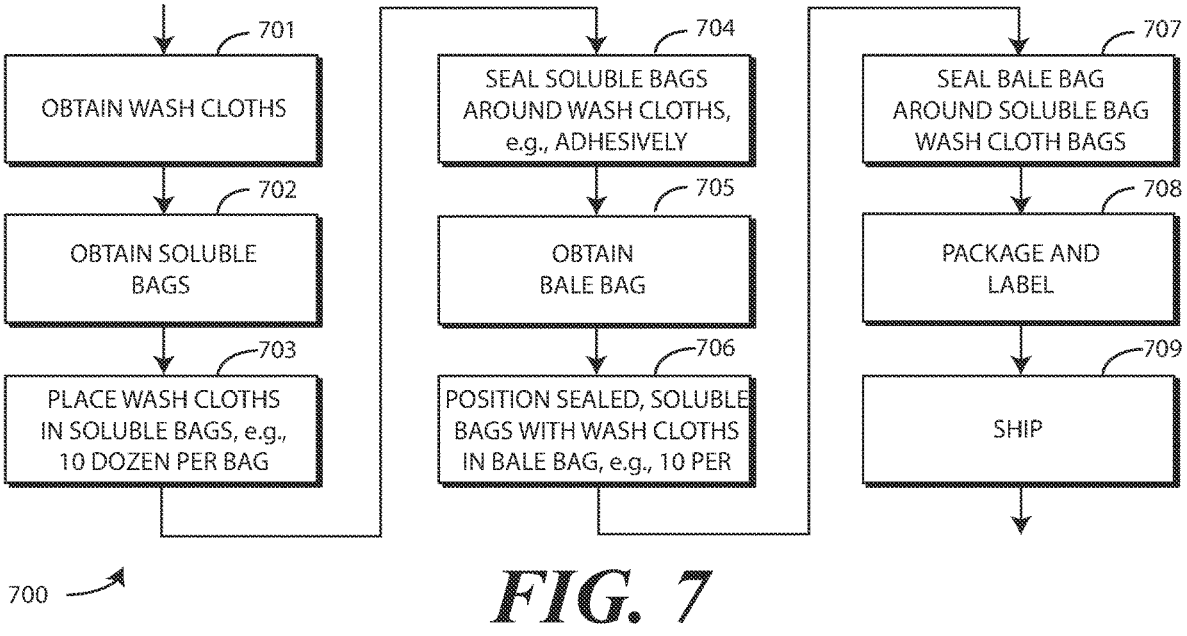
FIG. 7 illustrates one explanatory method in accordance with one or more embodiments of the disclosure.

Turning now to FIG. 7, illustrated therein is one explanatory method 700 summarizing the steps depicted in FIGS. 1-6. Beginning at step 701, a plurality of textile items is obtained. In one or more embodiments, these textile items comprise washcloths. However, the textile items could take other forms as well, as will be described below with reference to FIGS. 9 and 18.

At step 702, one or more dissolvable packages are obtained. At step 703, the textile items obtained at step 701 are placed into the dissolvable packages obtained at step 702. In one or more embodiments, this placement occurring at step 703 comprises placing ten dozen washcloths in each dissolvable package.

At step 704, the dissolvable packages are optionally sealed around the textile items so as to completely and fully enclose the textile items situated therein. (In some embodiments, the dissolvable packages may not be sealed.) In one or more embodiments, step 704 comprises sealing the dissolvable packages adhesively, although other sealing techniques can be used in other embodiments as noted above.

At step 705, a bale bag, one example of which is the outer packaging material (501) of FIGS. 5-6 above, is obtained. At step 706, the kits defined by the sealed dissolvable packages with the textile items situated therein are arranged in a kit arrangement. (In some embodiments, the dissolvable packages may not be sealed.) Where the textile items comprise square washcloths having side edge lengths of twelve inches, with those square washcloths stacked in stacks of ten dozen in each kit, step 706 can comprise constructing a kit arrangement having two columns of five kits, for a total of ten kits in the kit arrangement.

At step 707, the bale bag is sealed. In one or more embodiments, step 707 comprises sealing the bale bag adhesively, although other sealing techniques can be used in other embodiments as noted above. Step 708 can comprise packaging and labeling the resulting bale. Step 709 can then comprise shipping the bale to a laundry. As noted above, to launder the washcloths, the laundry technician need only open the bale bag and deposit one or more kits in the laundry machine. The kit takes care of depositing the washcloths situated therein into the wash water by dissolution, thereby eliminating waste, saving time, and reducing the amount of labor required to wash the washcloths in each kit. One hundred and twenty washcloths can be washed as a single unit rather than requiring one hundred and twenty separate retrieval, shaking, and deposit operations.

Figure 8:
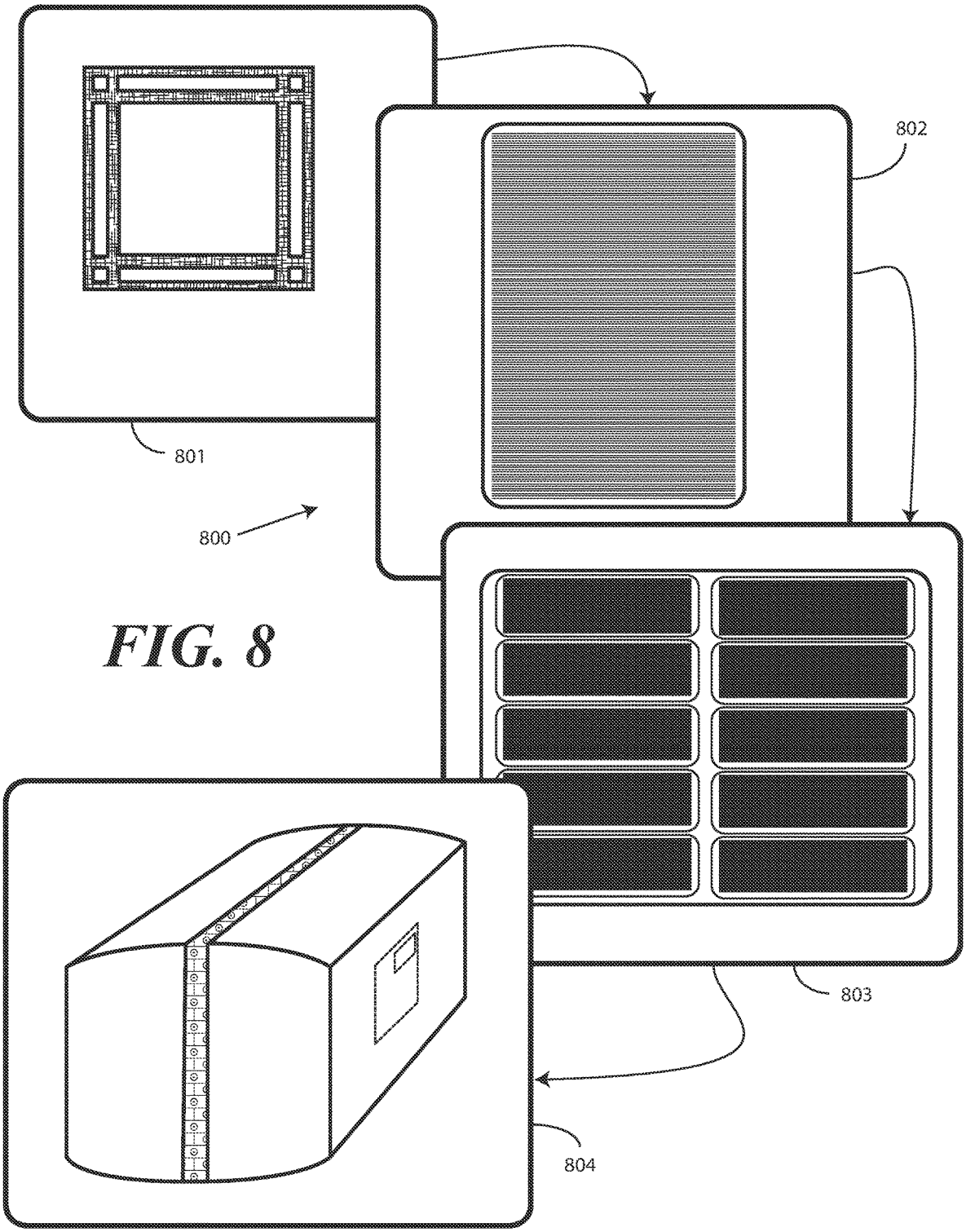
FIG. 8 illustrates another explanatory method in accordance with one or more embodiments of the disclosure.

Turning now to FIG. 8, illustrated therein is another method 800 configured in accordance with one or more embodiments of the disclosure. Beginning at step 801, a plurality of textile items is obtained. While a washcloth is shown illustratively at step 801, the textile items could take other forms as well. Illustrating by example, in other embodiments the textile items could be bath blankets or flat sheets.

At step 802, the textile items obtained at step 801 are arranged in a stack. As will be described in more detail below, in some embodiments a wash enabled self-unfolding fold is applied to each textile item prior to arranging the same in a stack. The wash enabled self-unfolding fold can comprise an accordion fold followed by a book fold. At step 802, a dissolvable package is sealed around the stack of textile items to form a kit.

At step 803, the kit is arranged with at least one other kit to form a kit arrangement. At step 803, the kit arrangement is positioned within a bale bag. At step 804, the bale bag is sealed.

Figure 9:
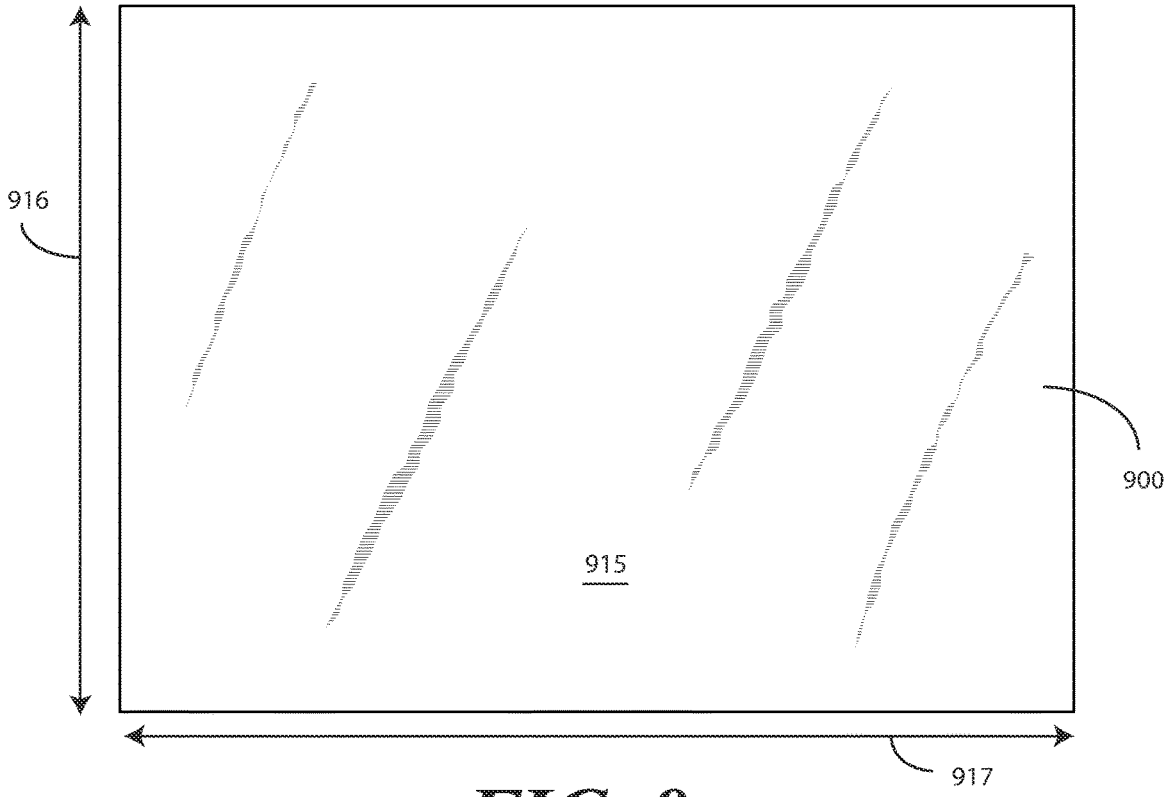
FIG. 9 illustrates another explanatory textile in accordance with one or more embodiments of the disclosure.

Turning now to FIG. 9, illustrated therein is another textile item configured in accordance with one or more embodiments of the disclosure. The textile item of FIG. 9 is shown illustratively as a towel or "bath blanket" 900. As shown, the bath blanket 900 defines a two-sided sheet of textile material 915. The two-sided sheet of textile material 915 can be manufactured from a textile material 915 that is woven or knit. The textile material 915 can further be manufactured with natural stretch capabilities. In other embodiments, the textile material 915 can be a standard weave without stretch capabilities.

In one or more embodiments, the textile material 915 is woven. For example, the textile material may include a one-ply weave, a two-ply weave, and so forth. The weave can include warps and wefts. In one or more embodiments, the weave of the textile material 915 is a taffeta weave.

The warps and wefts can include synthetic threads, organic threads, or combinations thereof. Illustrating by example, in one embodiment the warps and wefts comprise polyester. In another embodiment, the warps and wefts comprise cotton. In another embodiment, the warps and wefts comprise wool. Of course, combinations could be used as well. For instance, in another embodiment the warps and wefts can comprise a combination of cotton and polyester. Elastomeric materials may be interlaced with the weave to give the item a "stretchy" characteristic. Other examples of materials for the warps and wefts will be obvious to those of ordinary skill in the art having the benefit of this disclosure.

In the illustrative embodiment of FIG. 9, the bath blanket 900 is substantially rectangular in shape and is defined by a length 917 and a width 916. In one or more embodiments, the length 917 is about ninety inches, while the width 916 is about seventy inches. It should be noted that the width 916 and length 917 can take other dimensions as well.

Since the bath blanket 900 is quite large, it is folded before being positioned within a disposable package in one or more embodiments. In one or more embodiments, so as to unfold automatically in a washing machine once the dissolvable package dissolves, a wash enabled self-unfolding fold is applied to the bath blanket 900.

In one or more embodiments, the wash enabled self-unfolding fold comprises an accordion fold. As such, explanatory embodiments of the disclosure will be directed to using variations of an accordion fold to generate a wash enabled self-unfolding fold because testing has shown that this type of fold unfolds quickly and easily in a washing machine once a disposable package situated around the textiles has dissolved.

However, it should be noted that those of ordinary skill in the art having the benefit of this disclosure will find it obvious to try other folds, or non-folds, with embodiments of the disclosure as well. Illustrating by example, as will be described below with reference to FIG. 27, in other embodiments "jumble" packaging can be used where the textiles are jumbled together in a haphazard fashion and placed into a dissolvable package. In other embodiments, such as the one described below with reference to FIG. 28, interlocking folds can be substituted for the accordion-based folds described with reference to FIGS. 10-12 and 18-20.

Other types of folds that will be obvious to those of ordinary skill in the art having the benefit of this disclosure include balled up folds, twisted folds, rolled folds, and coiled folds. Embodiments of the disclosure contemplate that any technique that reduces an overall packaged size of a textile item from its original size that also self-unfolds through a traditional wash process can be used in accordance with embodiments of the disclosure. Additionally, while most disposable packaging described below is adhesively sealed, other techniques including vacuum sealing, compression prior to, or in addition to, sealing, and other tyles of sealing techniques can be used as well.

Moreover, while washcloths, bath blankets, and flat sheets will be discussed as explanatory textile examples to which an accordion-based wash enabled self-unfolding fold or other type of fold may be applied prior to placing the textiles in the disposable package, it will be obvious to those of ordinary skill in the art having the benefit of this disclosure that the techniques, kits, systems, and methods described herein can be used with other types of textiles as well. These textiles include towels, blankets, gowns, pillow cases, fitted sheets, "scrubs" and other medical apparel, and other non-medical apparel.

Figure 10:
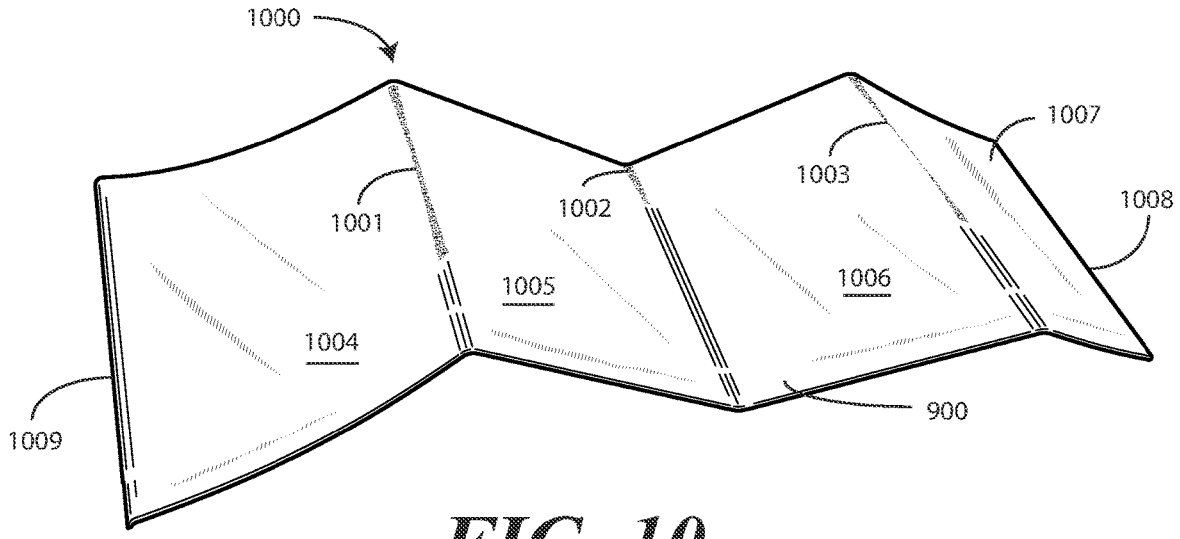
FIG. 10 illustrates one explanatory partially folded textile in accordance with one or more embodiments of the disclosure.

Turning now to FIG. 10, illustrated therein is a first portion of such a wash enabled self-unfolding fold. The folding method introduced in FIG. 10 facilitates quick, easy, and accurate loading and laundering of the bath blanket 900 when a kit comprising a plurality of the bath blankets positioned within a dissolvable package is placed into a laundering machine. Moreover, the folding method introduced in FIG. 10 can allow a single person to put multiple bath blankets in a laundering machine with a single motion, all the while having the confidence that each bath blanket will automatically unfold while being washed.

As shown in FIG. 10, to create the wash enabled self-unfolding fold an accordion fold 1000 is first applied to the bath blanket 900. The accordion fold 1000 of FIG. 10 is a "quad" accordion fold due to the fact that three folds 1001,1002,1003 have been introduced to create four panels 1004,1005,1006,1007 that are adjacently situated between the ends 1008,1009 of the bath blanket 900. In one or more embodiments where the bath blanket 900 has dimensions of about seventy inches by about ninety inches, the length of each panel 1004,1005,1006,1007 is about twenty-two and a half inches.

Figure 11:
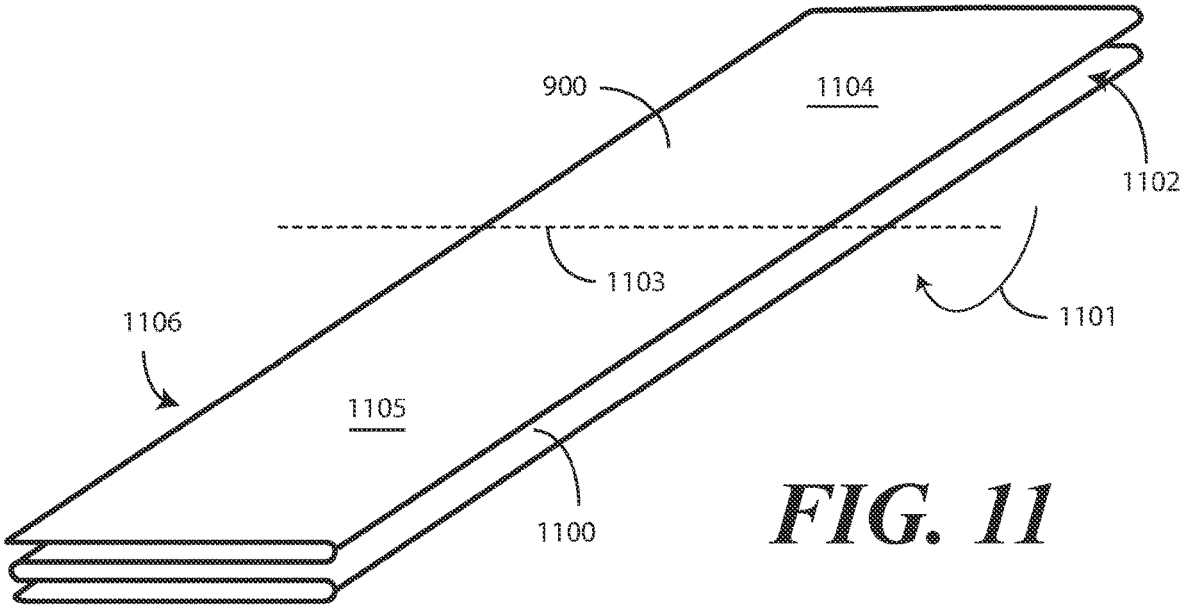
FIG. 11 illustrates another explanatory partially folded textile in accordance with one or more embodiments of the disclosure.

Turning now to FIG. 11, illustrated therein is the bath blanket 900 once the accordion fold 1000 has been applied to create a partially folded bath blanket 1100. The wash enabled self-unfolding fold is then completed by applying a book fold 1101 where a first half 1102 of the partially folded bath blanket 1100 is folded about a medial line 1103 such that its upper surface 1104 abuts the upper surface 1105 of the second half 1106 of the partially folded bath blanket 1100. In one or more embodiments, the first half 1102 of the partially folded bath blanket 1100 and the second half 1106 of the partially folded bath blanket 1100 each have a length measured from the ends of the partially folded bath blanket 1100 to the medial line 1103 of about thirty-five inches.

Figure 12:
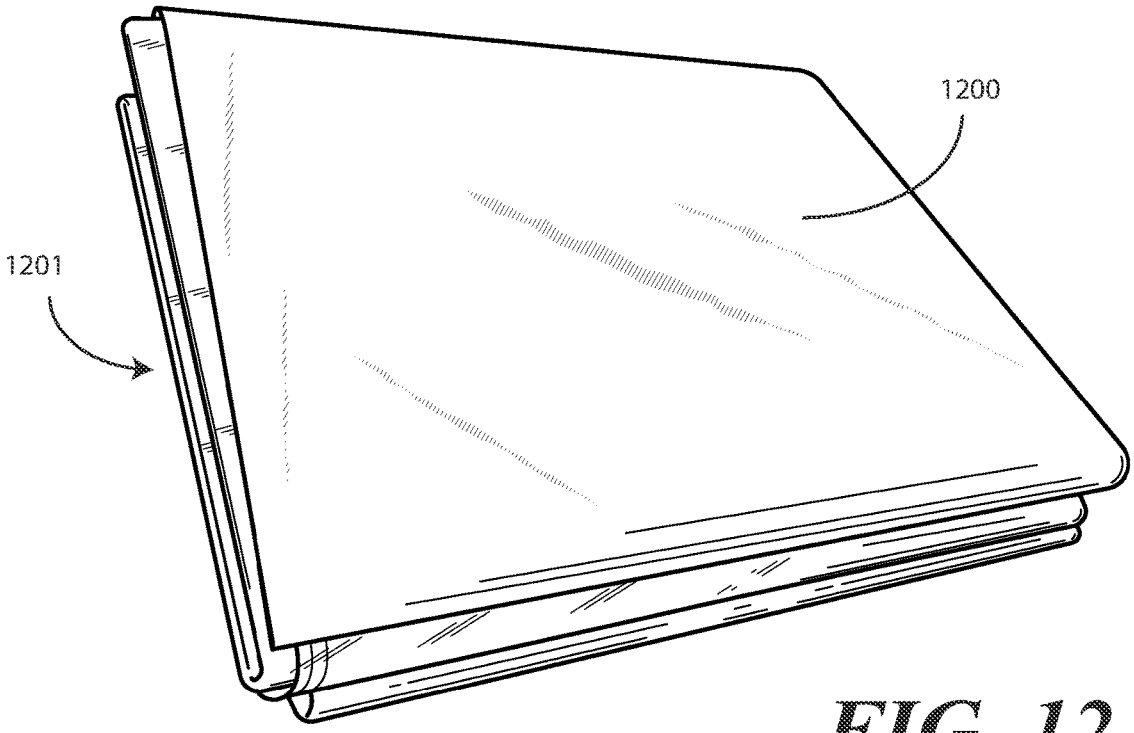
FIG. 12 illustrates one explanatory folded textile in accordance with one or more embodiments of the disclosure.

The resulting folded bath blanket 1200 with the wash enabled self-unfolding fold 1201 is shown in FIG. 12. It should be noted that the wash enabled self-unfolding fold 1201 of FIG. 12 is but one example of how a wash enabled self-unfolding fold can be configured in accordance with embodiments of the disclosure. In other embodiments, a folded bath blanket 1200 is formed using multiple accordion folds arranged in two different directions across the bath blanket (900). These multiple accordion folds can be tri-folds, quad-folds, or other types of folds.

In still other embodiments, the wash enabled self-unfolding fold 1201 is created by folding multiple bath blankets (900) together, with an accordion fold or otherwise. Illustrating by example, multiple bath blankets (900) can be folded together with interlocking folds in one or more embodiments. In still other embodiments, the wash enabled self-unfolding fold 1201 is formed from a rolled fold. Other examples of wash enabled self-unfolding folds 1201 will be obvious to those of ordinary skill in the art having the benefit of this disclosure.

Figure 13:
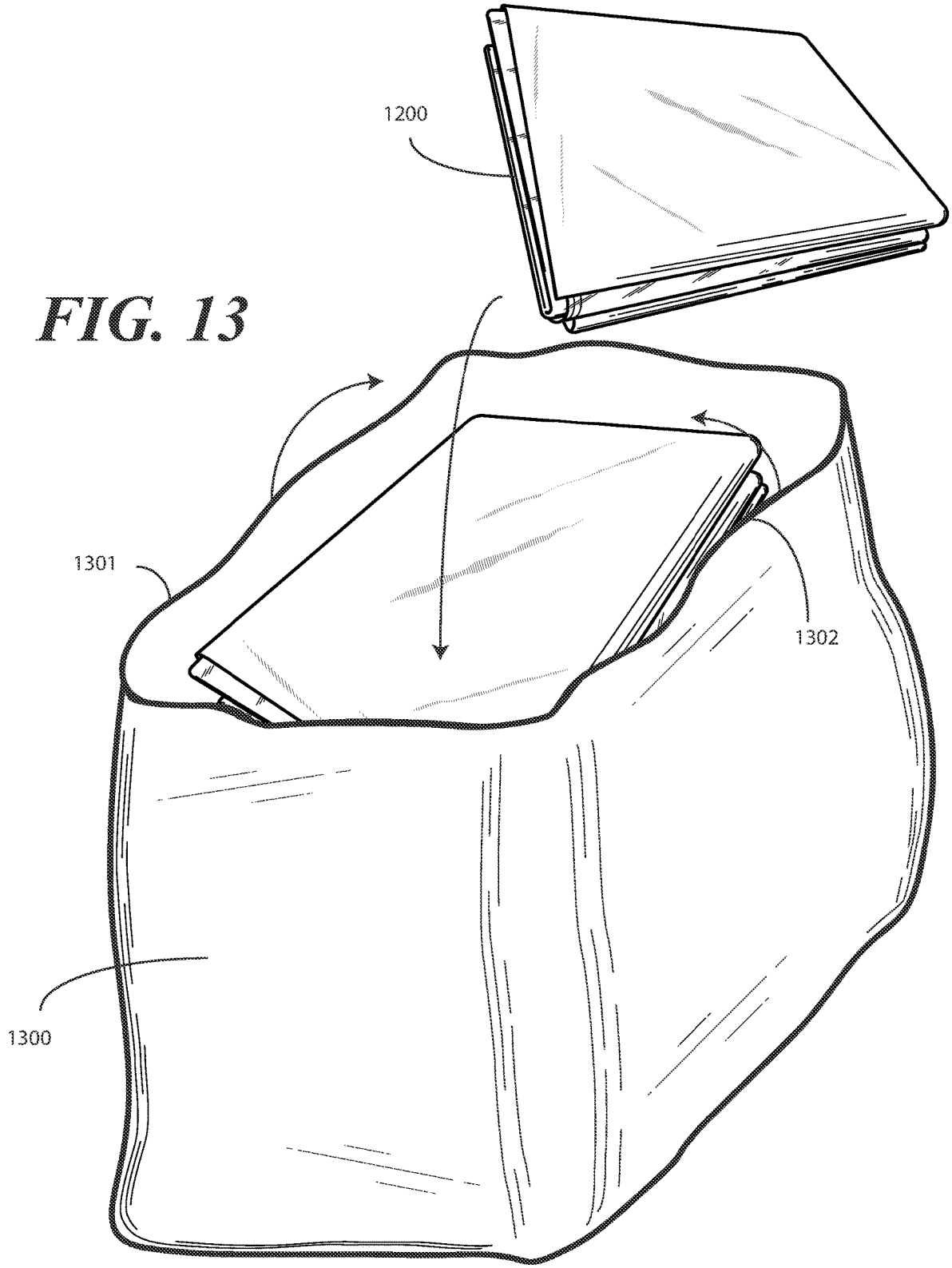
FIG. 13 illustrates another explanatory dissolvable package receiving textiles in accordance with one or more embodiments of the disclosure.

Turning now to FIG. 13, illustrated therein is the folded bath blanket 1200 of FIG. 12 being placed into dissolvable package 1300 configured in accordance with embodiments of the disclosure. As shown in FIG. 13, a plurality of folded bath blankets is being positioned within the dissolvable package 1300 in a stack. The dissolvable package 1300 of FIG. 13 can be constructed in a manner similar to that described above with reference to FIG. 2. In one or more embodiments, the dissolvable package 1300 of FIG. 13 will have different dimensions than the dissolvable package (200) of FIG. 2 due to the fact that the folded bath blanket 1200 has different dimensions than the washcloth (100) of FIG. 2.

In one or more embodiments, the dissolvable package 1300 is manufactured from a film layer that dissolves when it contacts water. Illustrating by example, in one or more embodiments the dissolvable package 1300 is manufactured from a film of polyvinyl alcohol. Since polyvinyl alcohol is soluble in water, in one or more embodiments when the film defining the dissolvable package 1300 is manufactured from polyvinyl alcohol the water will break down and dissolve the film of polyvinyl alcohol defining the sidewalls of the dissolvable package 1300, thereby releasing the folded bath blankets 1200 situated therein. When this water is within the confines of a laundering machine, this dissolution of the sidewalls of the dissolvable package 1300 allows the folded bath blanket 1200 to enter the wash water for proper laundering.

The fact that each folded bath blanket 1200 is folded with a wash enabled self-unfolding fold 1201 ensures that when each folded bath blanket 1200 enters the wash water it will self-release and "self-unfold" while being laundered. In one or more embodiments, the wash enabled self-unfolding allows each folded bath blanket 1200 to "open up" in the wash to be effectively cleaned and sanitized. Advantageously, the wash enabled self-unfolding fold 1201 eliminates the need for a technician to unfolding and/or "shake out" each folded bath blanket 1200 during the laundering process.

As with the embodiment of FIG. 2, in FIG. 13 only folded bath blankets 1200 are placed within the dissolvable package 1300 in one or more embodiments. However, in other embodiments additional items can be placed within the dissolvable package 1300 along with the folded bath blankets 1200 to make the laundering process more efficient. Illustrating by example, in one or more embodiments a package (203) of fabric softener is placed within the dissolvable package 1300 along with the folded bath blankets 1200. In another embodiment, a package (204) of water softener is placed within the dissolvable package 1300 along with the folded bath blankets 1200. In still another embodiment, a package (205) of anti-static additives is placed within the dissolvable package 1300 along with the folded bath blankets 1200. In still other embodiments, anionic surfactants (pre-detergents) that repel other parts of the textile itself so that the textiles more readily unfold can be included as well, as can be cationic sufactants that work in a similar manner to repel similar charges to assist the textiles in unfolding. Of course, these packages (203,204,205) could be placed in the dissolvable package 1300 in any combination as well.

In addition to these packages (203,204,205), packages of other materials could be included in the dissolvable package 1300 along with the folded bath blankets 1200 as well. Examples include packages of dye neutralizers, fabric expanders, antimicrobial agents, optical brighteners, delinters, moisture wickers, absorbency enhancers, and wrinkle reducers. These packages can be dissolvable as well and can be included in any combination in the dissolvable package 1300.

Where included these packages (203,204,205) can be constructed from dissolvable films as well. Accordingly, when the dissolvable package 1300 dissolves in the laundry, the package(s) (203,204,205) can dissolve as well, thereby releasing their fabric softening, water softening, and/or anti-static materials (or combinations thereof) into the wash water with the folded bath blankets 1200.

Figure 14:
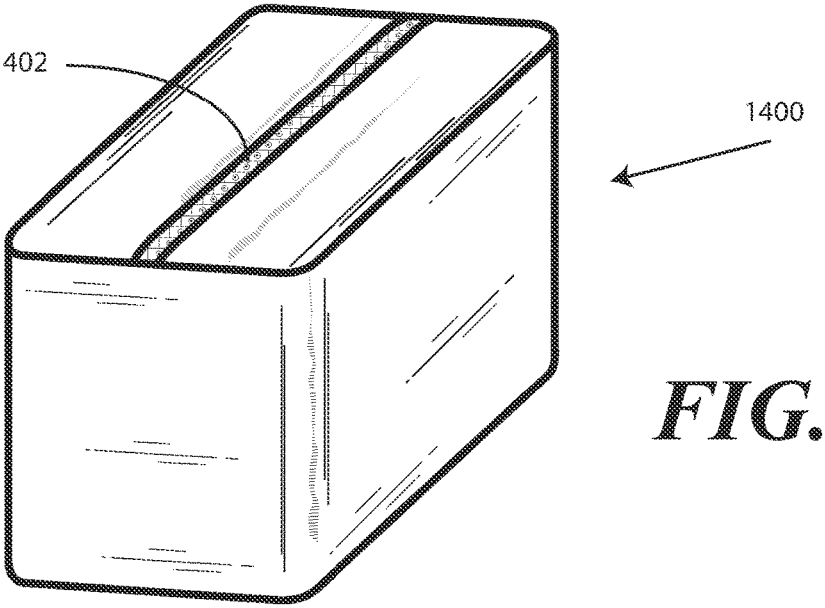
FIG. 14 illustrates another explanatory kit in accordance with one or more embodiments of the disclosure.

Once the folded bath blankets 1200 are all placed within the dissolvable package 1300, the side edges 1301 of the opening 1302 defined by the sidewalls of the dissolvable package 1300 can be closed. In one or more embodiments, the dissolvable package 1300 contains six folded bath blankets 1200. The opening 1302 of the dissolvable package 1300 can then be sealed to form a kit. Turning now to FIG. 14, illustrated therein is one explanatory kit 1400 in accordance with one or more embodiments of the disclosure.

As shown, the opening (1302) has been secured closed by a seal 1402. In one or more embodiments, the seal 1402 comprises an adhesive seal. In other embodiments, the opening (202) can be closed by a seal 1402 created by sonic welding, thermal welding, or a mechanical fastener. Other examples of seals 1402 will be obvious to those of ordinary skill in the art having the benefit of this disclosure.

Figure 15:
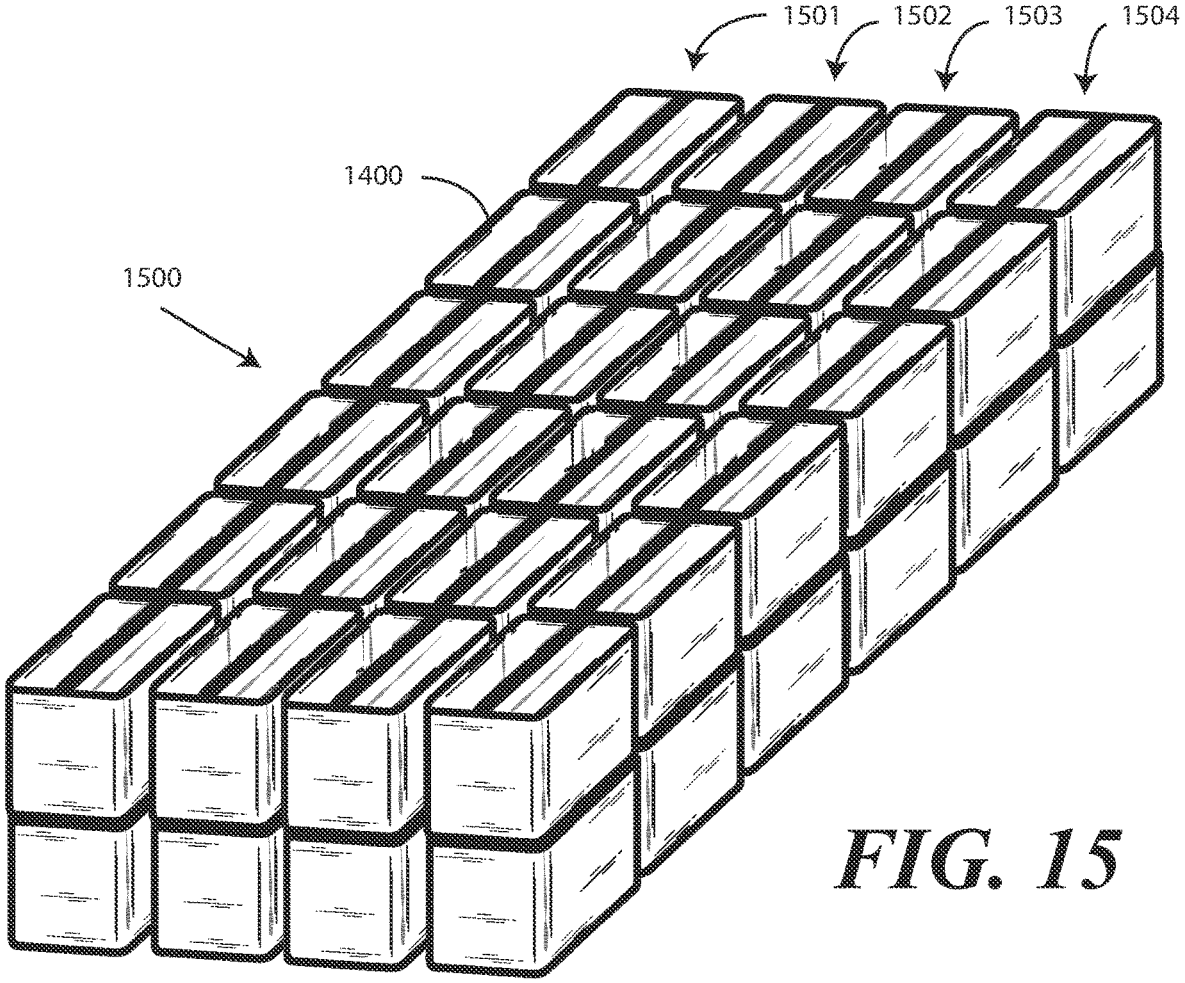
FIG. 15 illustrates another explanatory kit arrangement in accordance with one or more embodiments of the disclosure.

Turning now to FIG. 15, once each kit 1400 is constructed, a plurality of kits can be arranged in a kit arrangement 1500. In this illustrative embodiment, the kit arrangement 1500 comprises four columns 1501,1502, 1503,1504 of twelve kits, for a total of forty-eight kits. Embodiments of the disclosure contemplate that governmental and other regulations may limit the number of kits that can be placed in a single package. Accordingly, the kit arrangement 1500 of FIG. 15 is intended to meet such regulations by placing less than fifty kits in a single package.

Figure 16:
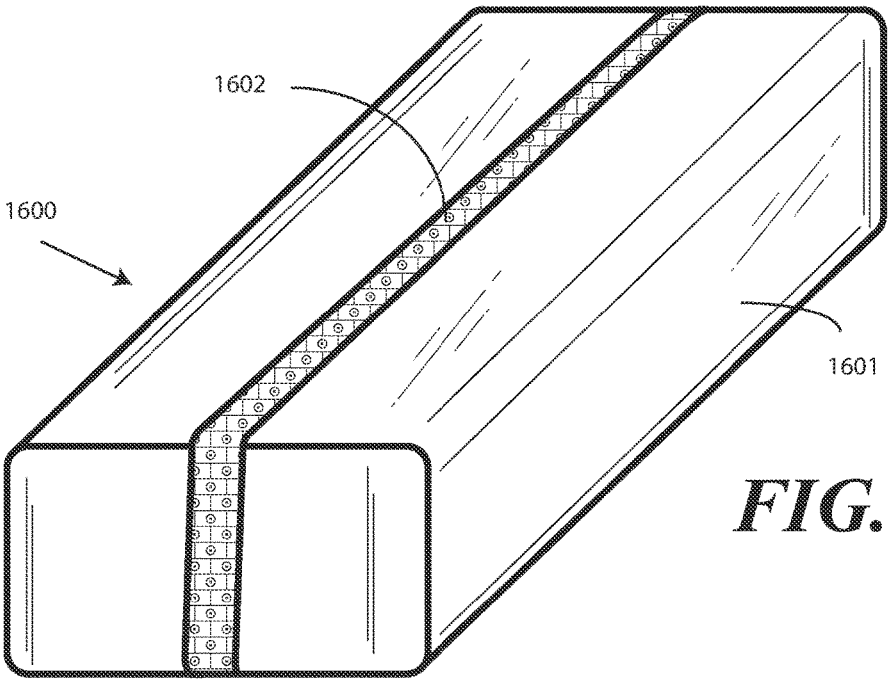
FIG. 16 illustrates another explanatory packaged kit arrangement in accordance with one or more embodiments of the disclosure.

Once the kit arrangement 1500 is made, it can be packaged in a "bale" in one or more embodiments. Turning now to FIG. 16, once the outer packaging material 1601 has been placed around the kit arrangement (1500), the outer packaging material 1601 can be sealed with a seal 1602 to define a packaged kit arrangement or "bale" 1600. In one or more embodiments, the seal 1602 comprises an adhesive seal. However, in other embodiments the seal 1602 is formed by a mechanical fastener, ultrasonic welding, or thermal welding. In still other embodiments, the seal 1602 can be formed by a hood closure attached to the dissolvable package. In other embodiments, the seal 1602 can be created by compression or vacuum sealing.

In still other embodiments, there will be no seal 1602. Instead, the outer packaging material 1601 can simply be wrapped around the kit arrangement (1500) with open ends. Alternatively, the outer packaging material 1601 can be tied with string. The string could be manufactured from a dissolvable material. In still other embodiments, the outer packaging material 1601 itself can be tied around the kit arrangement (1500). In other embodiments, the outer packaging material can be tied shut with a washable product, examples of which include sheets, pillowcases, towels, and napkins. Other examples of seals 1602 and/or how to close the outer packaging material 1601 will be obvious to those of ordinary skill in the art having the benefit of this disclosure.

This bale 1600 can then be shipped to a laundry facility for laundering. The bale 1600 solves problems associated with prior art textile item packaging systems. Specifically, the placement of folded bath blankets (1200) that are configured with a wash enabled self-unfolding fold (1201) in a dissolvable package (1300) dramatically reduces the time, effort, labor, and stress of laundering the bath blankets (900). This is true because there is no requirement to either unpack the folded bath blanket (1200) from the dissolvable package (1300), unfold them, or to shake them out one-by-one when placing them in the laundry machine. Instead, the seal 1602 of the outer packaging material 1601 is simply opened. Each kit (1400) can then be retrieved and simply be placed into a laundry machine as a whole.

When washed, the dissolvable package (1300) dissolves and the wash with the folded bath blankets (1200) then entering the wash water. Since they are folded with a wash enabled self-unfolding fold (1201), they automatically unfold in the wash water. Said differently, once the dissolvable package (1300) dissolves, each folded bath blanket (1200) self-releases and "self-unfolds" when being laundered. That the wash enabled self-unfolding folded bath blankets (1200) are placed in a dissolvable package (1300) dramatically reduces the time, effort, labor, and stress of laundering the same due to the fact that there is no longer either a requirement to unpack or to shake out folded bath blankets (1200). Additionally, there is no longer a need to handle each folded bath blanket (1200) one by one. Instead, an entire kit (1400) can simply be placed into a laundry machine as a whole. When washed, the dissolvable package (1300) dissolves and the wash enabled self-unfolding folded bath blankets (1200) self-unfold.

In effect, the wash enabled self-unfolding fold (1201) allows each folded bath blanket (1200) to "open up" in the wash to be effectively cleaned and sanitized. The wash enabled self-unfolding folding technique allows for bypassing the unfolding or "shake out" step of the prior art laundering process. Stacking the wash enabled self-unfolding folded bath blanket (1200) in the dissolvable package (1300) also allows for easy management of the kits (1400) during laundering and transport.

Figure 17:
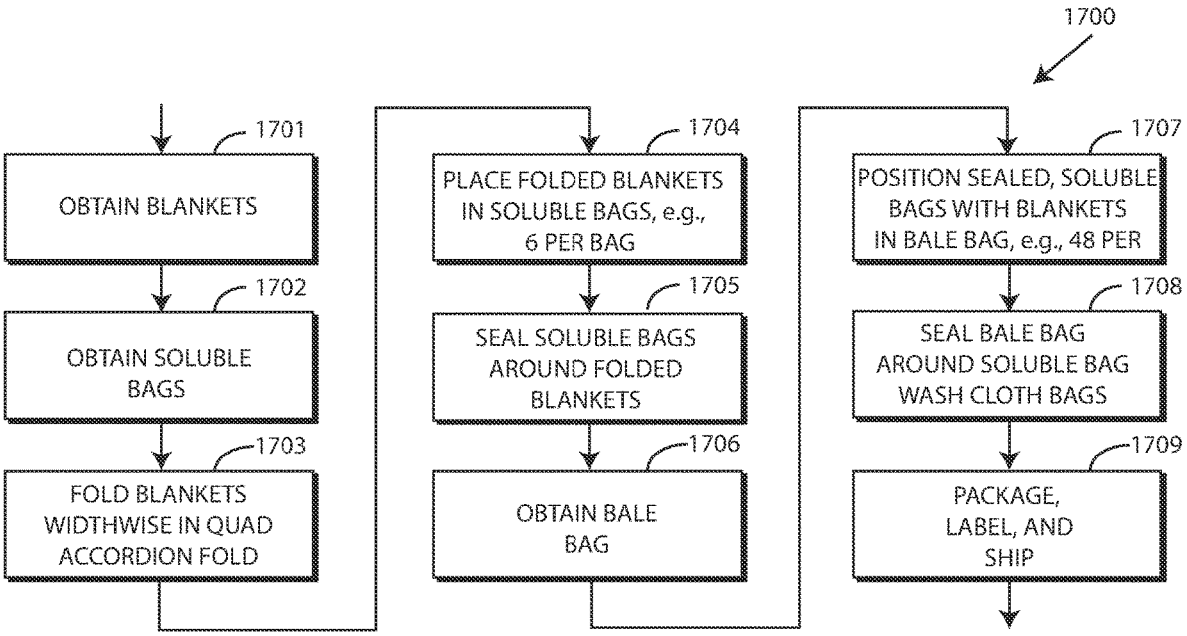
FIG. 17 illustrates another explanatory method in accordance with one or more embodiments of the disclosure.

Turning now to FIG. 17, illustrated therein is one explanatory method 1700 summarizing the steps depicted in FIGS.

9-16. Beginning at step 1701, a plurality of textile items is obtained. In one or more embodiments, these textile items comprise bath blankets. However, the textile items could take other forms as well, as noted above and as will be described below with reference to FIG. 18.

At step 1702, one or more dissolvable packages are obtained. At step 1703, the bath blankets obtained at step 1701 are folded with a wash enabled self-unfolding fold. In one or more embodiments, the wash enabled self-unfolding fold comprises an accordion fold that is first applied to the bath blanket, followed by a book fold. In one or more embodiments, the accordion fold is a "quad" accordion fold creating four panels separated by three folds. In one or more embodiments, the book fold folds a first half of a partially folded bath blanket about a medial line such that a surface of the first half abuts a surface of a second half of the partially folded bath blanket.

In other embodiments, the wash enabled self-unfolding fold applied at step 1703 is formed using multiple accordion folds arranged in two different directions across the bath blanket. These multiple accordion folds can be trifolds, quad-folds, or other types of folds.

In still other embodiments, the wash enabled self-unfolding fold applied at step 1703 is formed by folding multiple bath blankets together, with an accordion fold, an interlocking fold, or otherwise. In still other embodiments, the wash enabled self-unfolding fold formed at step 1703 is a rolled fold. Other examples of wash enabled self-unfolding folds suitable for application at step 1703 will be obvious to those of ordinary skill in the art having the benefit of this disclosure.

At step 1704, folded bath blankets are placed into the dissolvable packages obtained at step 1702. In one or more embodiments, this placement occurring at step 1704 comprises placing six folded bath blankets in each dissolvable package.

At step 1705, the dissolvable packages are sealed around the textile items so as to completely and fully enclose the textile items situated therein. In one or more embodiments, step 1705 comprises sealing the dissolvable packages adhesively, although other sealing techniques can be used in other embodiments as noted above.

At step 1706, a bale bag is obtained. At step 1707, the kits defined by the sealed dissolvable packages with the textile items situated therein are arranged in a kit arrangement. Where the textile items comprise folded bath blankets such as that shown in FIG. 12, with those folded bath blankets stacked in stacks of six in each kit, step 1707 can comprise constructing a kit arrangement having four columns of twelve kits, for a total of forty-eight kits in the kit arrangement.

The bale bag can then be sealed at step 1708. In one or more embodiments, step 1708 comprises sealing the bale bag adhesively, although other sealing techniques can be used in other embodiments as noted above. Step 1709 can comprise packaging and labeling the resulting bale. Step 1709 can also comprise shipping the bale to a laundry. As noted above, to launder the folded bath blankets, the laundry technician need only open the bale bag and deposit one or more kits in the laundry machine. The kit takes care of depositing the folded bath blanket situated therein into the wash water by dissolution. This also causes each folded bath blanket to automatically unfold. The use of the dissolvable package eliminates waste, saves time, and reduces the amount of labor required to wash the bath blankets in each kit. Six folded bath blankets can be washed as a single unit rather than requiring six separate retrieval, shaking, and deposit operations.

Figure 18:
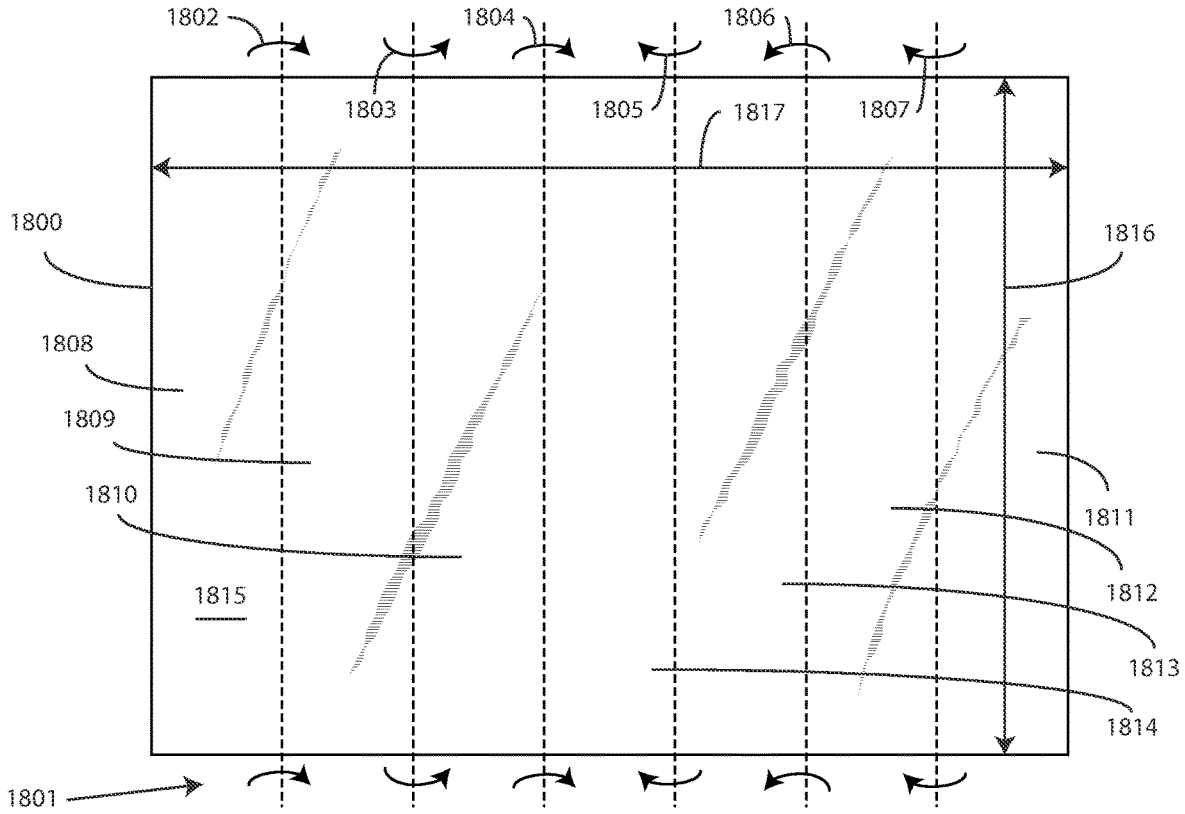
FIG. 18 illustrates yet another explanatory textile in accordance with one or more embodiments of the disclosure.

Turning now to FIG. 18, illustrated therein is another textile item configured in accordance with one or more embodiments of the disclosure. The textile item of FIG. 18 is shown illustratively as a flat sheet 1800. As shown, the flat sheet 1800 defines a two-sided sheet of textile material 1815. The two-sided sheet of textile material 1815 can be manufactured from a textile material 1815 that is woven or knit. The textile material 1815 can further be manufactured with natural stretch capabilities. In other embodiments, the textile material 1815 can be a standard weave without stretch capabilities.

As shown in FIG. 18, the flat sheet 1800 is substantially rectangular in shape and is defined by a length 1817 and a width 1816. In one embodiment, the length 1817 is about one hundred and twelve inches, while the width 1816 is about sixty-six inches. It should be noted that the width 1816 and length 1817 can change depending upon the size mattress the flat sheet 1800 is designed to fit. Generally speaking, the width 1816 will substantially equal in width to the width of a mattress that will be covered by the flat sheet 1800, plus about two times the depth of the mattress. Meanwhile, length 1817 of the flat sheet 1800 may be substantially equal to the length of the selected mattress, plus about one to two times the depth of the mattress.

In one or more embodiments, the textile material 1815 is woven. For example, the textile material may include a one-ply weave, a two-ply weave, and so forth. The weave can include warps and wefts. In one or more embodiments, the weave of the textile material 1815 is a taffeta weave. The warps and wefts can include synthetic threads, organic threads, or combinations thereof. Elastomeric materials may be interlaced with the weave to give the item a "stretchy" characteristic.

Since the flat sheet 1800 is quite large, it is folded before being positioned within a disposable package in one or more embodiments. In one or more embodiments, so as to unfold automatically in a washing machine once the dissolvable package dissolves, a wash enabled self-unfolding fold is applied to the flat sheet 1800.

As shown in FIG. 18, the first portion of such a wash enabled self-unfolding comprises an accordion fold 1801 to the flat sheet 1800. In one or more embodiments, the accordion fold 1801 is a "sept" accordion fold due to the fact that six folds 1802,1803,1804,1805,1806,1807 are introduced to define seven panels 1808,1809,1810,1811,1812,1813,1814 that are adjacently situated between the ends of the flat sheet 1800. In one or more embodiments where the flat sheet 1800 has dimensions of about one hundred and twelve by about sixty-six inches, the length of each panel 1808,1809,1810,1811,1812,1813,1814 is about sixteen inches. This "sept" accordion fold 1801 is shown in more detail in FIG. 19.

Figure 19:
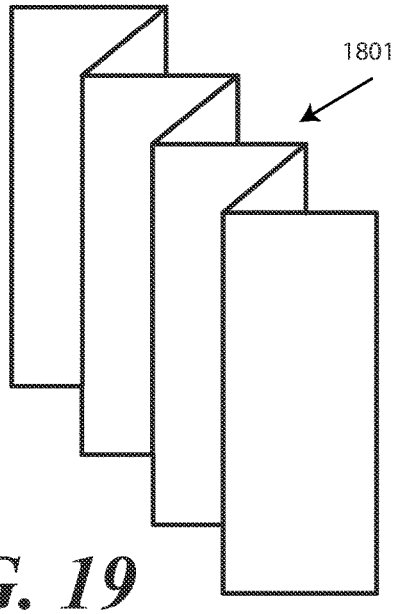
FIG. 19 illustrates one explanatory partially folded textile in accordance with one or more embodiments of the disclosure.
Figure 20:
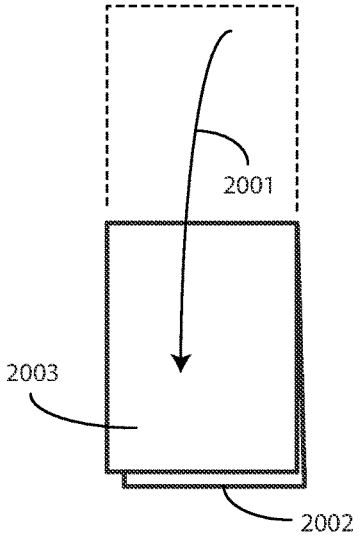
FIG. 20 illustrates one explanatory folded textile in accordance with one or more embodiments of the disclosure.

Turning now to FIG. 20, once the accordion fold (1801) has been applied to create a partially folded flat sheet, the wash enabled self-unfolding fold of this illustrative embodiment is then completed by applying a book fold 2001 where a first half 2002 of the partially folded flat sheet of FIG. 19 is folded about a medial line such that a major surface abuts a major surface of the second half 2003 of the partially folded flat sheet. In one or more embodiments, the first half 2002 of the partially folded flat sheet and the second half 2003 of the partially folded flat sheet each have a length measured from the ends of the partially folded flat sheet to the medial line of about thirty-three inches.

Figure 21:
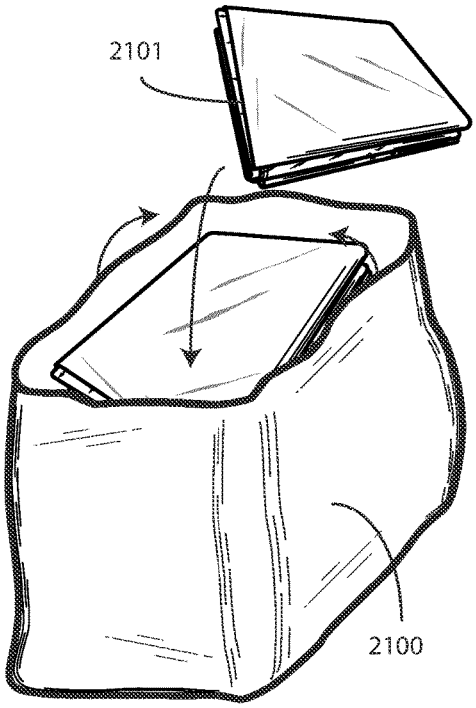
FIG. 21 illustrates yet another explanatory dissolvable package receiving textiles in accordance with one or more embodiments of the disclosure.

Turning now to FIG. 21, illustrated therein is the resulting folded flat sheet 2101 being placed into dissolvable package 2100 configured in accordance with embodiments of the disclosure. In one or more embodiments, a plurality of folded flat sheets is being positioned within the dissolvable package 2100 in a stack. The dissolvable package 2100 of FIG. 21 can be constructed in a manner similar to that described above with reference to FIG. 2. In one or more embodiments, the dissolvable package 2100 of FIG. 21 will have different dimensions than the dissolvable package (200) of FIG. 2 or the dissolvable package (1300) of FIG. 13 due to the fact that the folded flat sheet 2101 has different dimensions than the washcloth (100) of FIG. 2 or the folded bath blanket (1200) of FIG. 12.

In one or more embodiments, the dissolvable package 2100 is manufactured from a film layer that dissolves when it contacts water. Illustrating by example, in one or more embodiments the dissolvable package 2100 is manufactured from a film of polyvinyl alcohol. Since polyvinyl alcohol is soluble in water, in one or more embodiments when the film defining the dissolvable package 2100 is manufactured from polyvinyl alcohol the water will break down and dissolve the film of polyvinyl alcohol defining the sidewalls of the dissolvable package 2100, thereby releasing the folded flat sheets 2101 situated therein. When this water is within the confines of a laundering machine, this dissolution of the sidewalls of the dissolvable package 1300 allows the folded bath blanket 1200 to enter the wash water for proper laundering.

The fact that each folded flat sheet 2101 is folded with a wash enabled self-unfolding created by the method shown in FIGS. 18-20, or by other methods described herein, ensures that when each folded flat sheet 2101 enters the wash water it will self-release and "self-unfold" while being laundered. In one or more embodiments, the wash enabled self-unfolding allows each folded flat sheet 2101 to "open up" in the wash to be effectively cleaned and sanitized. Advantageously, the wash enabled self-unfolding fold eliminates the need for a technician to unfolding and/or "shake out" each folded flat sheet 2101 during the laundering process.

As with previous embodiments, additional items can optionally be placed within the dissolvable package 2100 along with the folded flat sheets 2101 to make the laundering process more efficient. Illustrating by example, in one or more embodiments a package (203) of fabric softener is placed within the dissolvable package 2100 along with the folded flat sheets 2101. In another embodiment, a package (204) of water softener is placed within the dissolvable package 2100 along with the folded flat sheets 2101. In still another embodiment, a package (205) of anti-static additives is placed within the dissolvable package 2100 along with the folded flat sheets 2101. In still other embodiments, anionic surfactants (pre-detergents) that repel other parts of the textile itself so that the textiles more readily unfold can be included as well, as can be cationic sufactants that work in a similar manner to repel similar charges to assist the textiles in unfolding. Of course, these packages (203,204,205) could be placed in the dissolvable package 2100 in any combination as well.

In addition to these packages (203,204,205), packages of other materials could be included in the dissolvable package 2100 along with the folded flat sheets 2101 as well. Examples include packages of dye neutralizers, fabric expanders, antimicrobial agents, optical brighteners, delinters, moisture wickers, absorbency enhancers, and wrinkle reducers. These packages can be dissolvable as well and can be included in any combination in the dissolvable package 2100.

Where included these packages (203,204,205) can be constructed from dissolvable films as well. Accordingly, when the dissolvable package 2100 dissolves in the laundry, the package(s) (203,204,205) can dissolve as well, thereby releasing their fabric softening, water softening, and/or anti-static materials (or combinations thereof) into the wash water with the folded flat sheets 2101.

Figure 22:
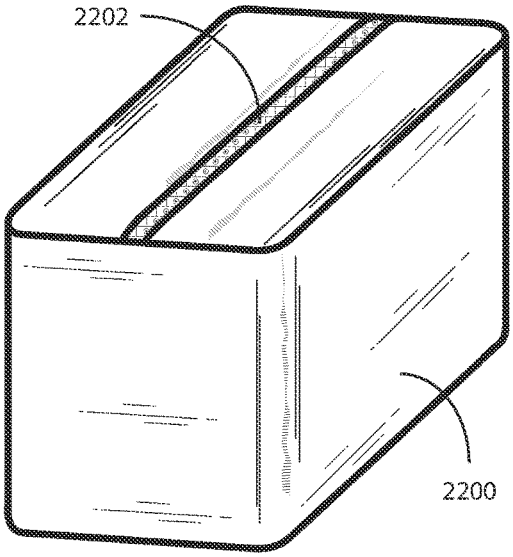
FIG. 22 illustrates yet another explanatory kit in accordance with one or more embodiments of the disclosure.

Once the folded flat sheets 2101 are all placed within the dissolvable package 2100, the side edges of the opening defined by the sidewalls of the dissolvable package 2100 can be closed. In one or more embodiments, the dissolvable package 2100 contains twelve folded flat sheets 2101. The opening of the dissolvable package 2100 can then be sealed to form a kit. Turning now to FIG. 22, illustrated therein is one explanatory kit 2200 in accordance with one or more embodiments of the disclosure.

As shown, the opening has been secured closed by a seal 2202. In one or more embodiments, the seal 2202 comprises an adhesive seal. In other embodiments, the opening can be closed by a seal 2202 created by sonic welding, thermal welding, or a mechanical fastener. Other examples of seals 2202 will be obvious to those of ordinary skill in the art having the benefit of this disclosure.

Figure 23:
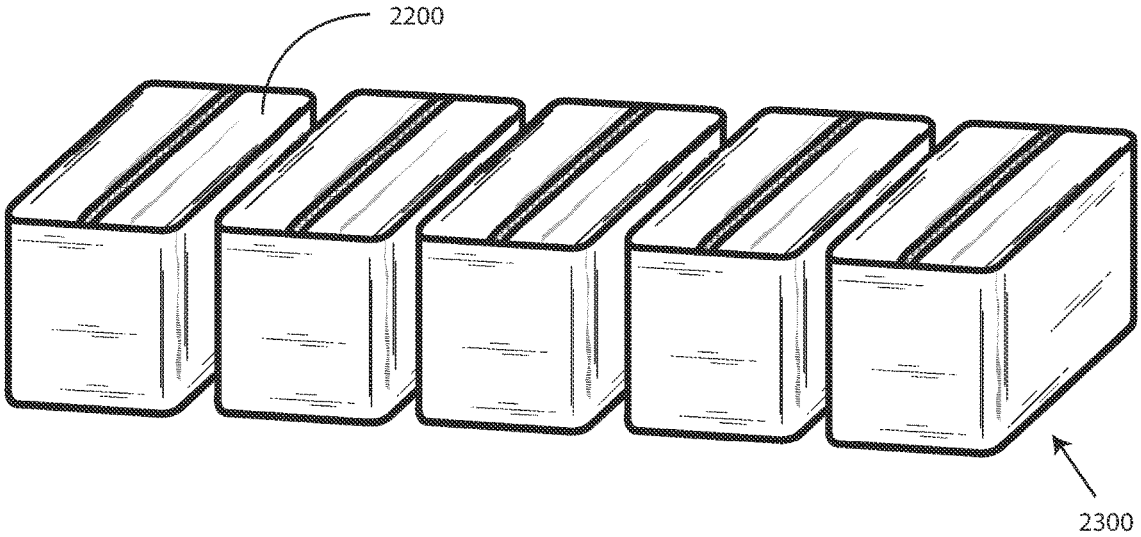
FIG. 23 illustrates yet another explanatory kit arrangement in accordance with one or more embodiments of the disclosure.

Turning now to FIG. 23, once each kit 2200 is constructed, a plurality of kits can be arranged in a kit arrangement 2300. In this illustrative embodiment, the kit arrangement 1500 comprises one column of five kits. Embodiments of the disclosure contemplate that governmental and other regulations may limit the number of kits that can be placed in a single package. Accordingly, the kit arrangement 2300 of FIG. 23 is intended to meet such regulations by placing five or fewer in a single package.

Figure 24:
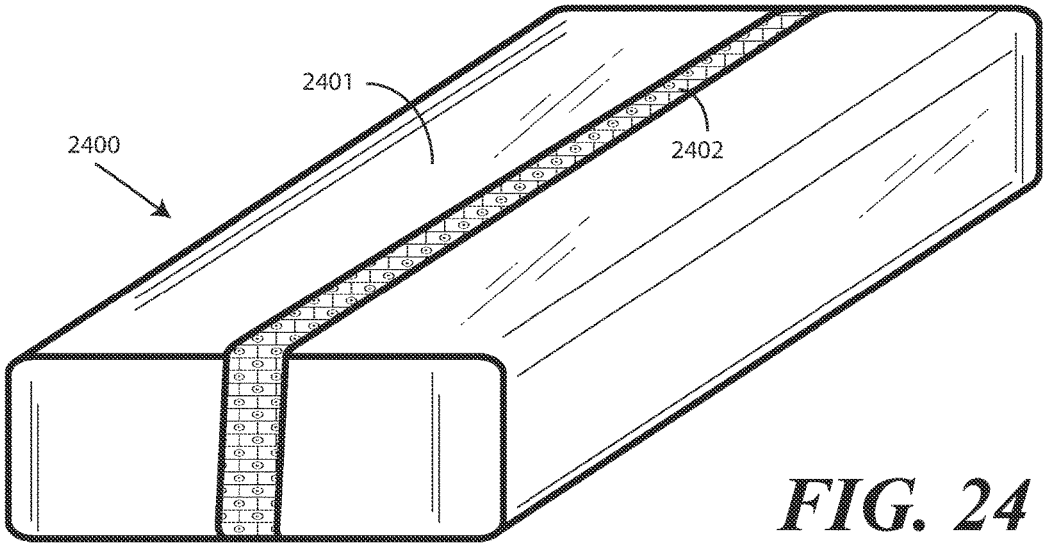
FIG. 24 illustrates yet another explanatory packaged kit arrangement in accordance with one or more embodiments of the disclosure.

Once the kit arrangement 2300 is made, it can be packaged in a "bale" in one or more embodiments. Turning now to FIG. 24, once the outer packaging material 2401 has been placed around the kit arrangement (2300), the outer packaging material 2401 can be sealed with a seal 2402 to define a packaged kit arrangement or "bale" 2400. In one or more embodiments, the seal 1602 comprises an adhesive seal. However, in other embodiments the seal 2402 is formed by a mechanical fastener, ultrasonic welding, or thermal welding. In still other embodiments, the seal 2402 can be formed by a hood closure attached to the dissolvable package. In other embodiments, the seal 2402 can be created by compression or vacuum sealing.

In still other embodiments, there will be no seal 2402. Instead, the outer packaging material 2401 can simply be wrapped around the kit arrangement (2300) with open ends. Alternatively, the outer packaging material 2401 can be tied with string. The string could be manufactured from a dissolvable material. In still other embodiments, the outer packaging material 2401 itself can be tied around the kit arrangement (2300). In other embodiments, the outer packaging material can be tied shut with a washable product, examples of which include sheets, pillowcases, towels, and napkins. Other examples of seals 2402 and/or how to close the outer packaging material 2401 will be obvious to those of ordinary skill in the art having the benefit of this disclosure.

This bale 2400 can then be shipped to a laundry facility for laundering. The bale 2400 solves problems associated with prior art textile item packaging systems. Specifically, the placement of folded flat sheets (2101) that are configured with a wash enabled self-unfolding fold in a dissolvable package (2100) dramatically reduces the time, effort, labor, and stress of laundering the flat sheets (1800). This is true because there is no requirement to either unpack the folded flat sheets (2101) from the dissolvable package (2100), unfold them, or to shake them out one-by-one when placing them in the laundry machine. Instead, the seal 2402 of the outer packaging material 2401 is simply opened. Each kit (2200) can then be retrieved and simply be placed into a laundry machine as a whole.

When washed, the dissolvable package (2100) dissolves and the wash with the folded flat sheets (2101) then entering the wash water. Since they are folded with a wash enabled self-unfolding fold, they automatically unfold in the wash water. Said differently, once the dissolvable package (2100) dissolves, each folded flat sheet (2101) self-releases and "self-unfolds" when being laundered. That the wash enabled self-unfolding folded flat sheets are placed in a dissolvable package (2100) dramatically reduces the time, effort, labor, and stress of laundering the same due to the fact that there is no longer either a requirement to unpack or to shake out folded flat sheets (2101). Additionally, there is no longer a need to handle each folded flat sheet (2101) one by one. Instead, an entire kit (2200) can simply be placed into a laundry machine as a whole. When washed, the dissolvable package (2100) dissolves and the wash enabled self-unfolding folded flat sheets (2101) self-unfold.

Figure 27:
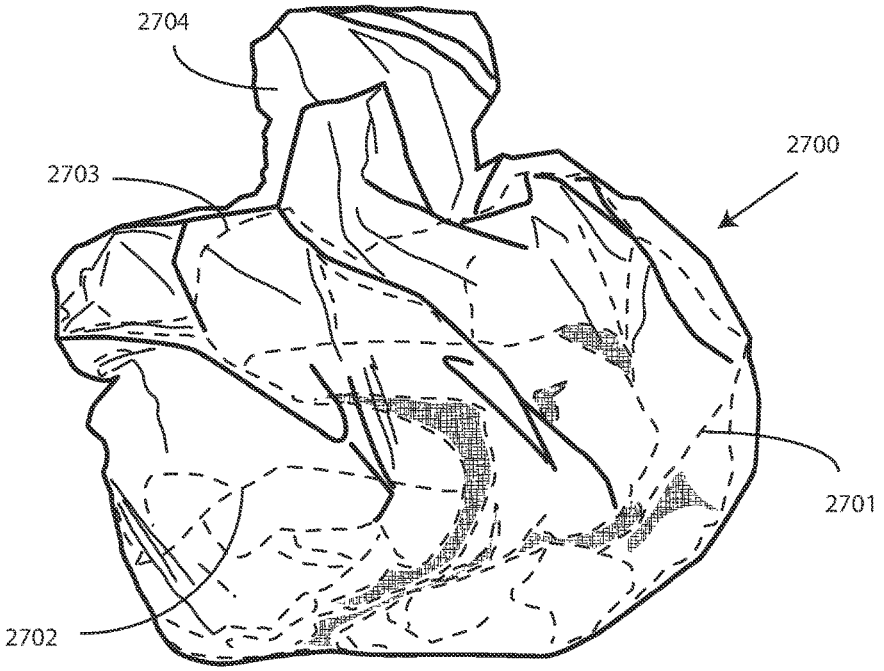
FIG. 27 illustrates one explanatory jumble pack in accordance with one or more embodiments of the disclosures.
Figure 28:
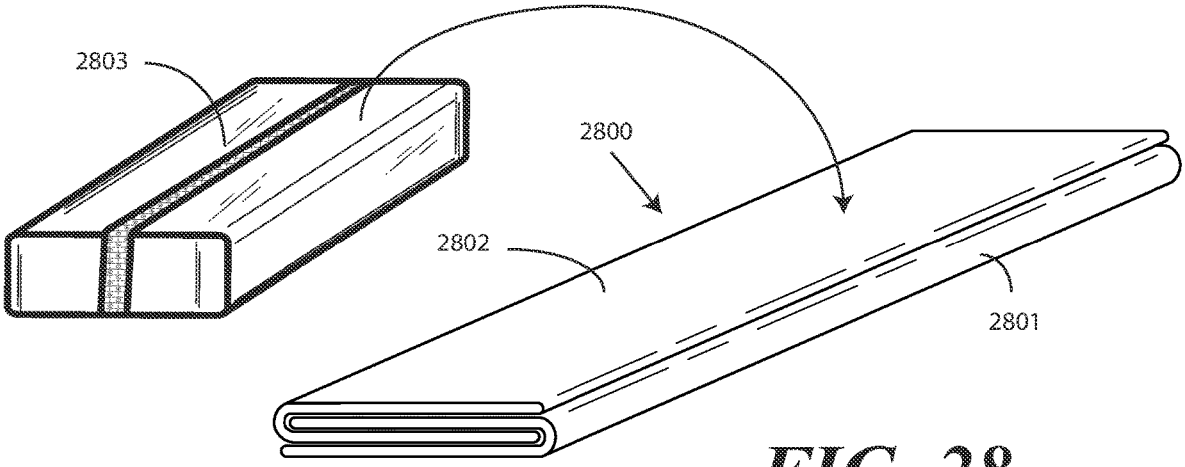
FIG. 28 illustrates one explanatory kit with textiles situated therein in interlocking configuration in accordance with one or more embodiments of the disclosure.

To this point, the explanatory wash enabled self-unfolding folds have been accordion based. While this type of wash enabled self-unfolding fold is advantageous in that it works really well, embodiments of the disclosure contemplate that disposable packaging can be used with textiles that are manipulated in other ways prior to packaging as well. Turning now to FIGS. 27-28, illustrated therein are two such examples. Others will be obvious to those of ordinary skill in the art having the benefit of this disclosure.

Beginning with FIG. 27, illustrated therein is what is known as a "jumble package" 2700 where textiles 2701, 2702,2703 jumbled together in a haphazard fashion and placed into a dissolvable package 2704. This type of packaging is quick and simple, and is especially useful when the textiles 2701,2702,2703 are soiled. However, this type of packaging can be used by a textile manufacturer as well, in that placement of the textiles 2701,2702,2703 into the dissolvable package 2704 is quick and easy. In some embodiments the dissolvable package 2704 will be sealed when the jumble package 2700 is complete. By contrast, in other embodiments the dissolvable package 2704 will be left unsealed. In the illustrative embodiment of FIG. 27, the dissolvable package is unsealed.

Turning now to FIG. 28, illustrated therein are textiles 2801,2802 that are arranged in an interlocking fold 2800. While two textiles 2801,2802 are shown in FIG. 28, it will be clear to those of ordinary skill in the art having the benefit of this disclosure that three, four, five or more textiles could be placed into the dissolvable package 2803. Using the interlocking fold 2800, portions of each textile 2801,2802 wrap around a portion of at least one other textile. Illustrating by example, in FIG. 28 two portions of textile 2801 wrap around one portion of textile 2802, while two portions of textile 2802 wrap around one portion of textile 2801. If a third textile were included, the two portions of textile 2802 would wrap around a portion of the textile 2801 and a portion of the third textile, and so forth. The dissolvable package 2803 can then be sealed or left unsealed, arranged in rows and stacks, baled, and otherwise used as described above with previous embodiments.

Figure 25:
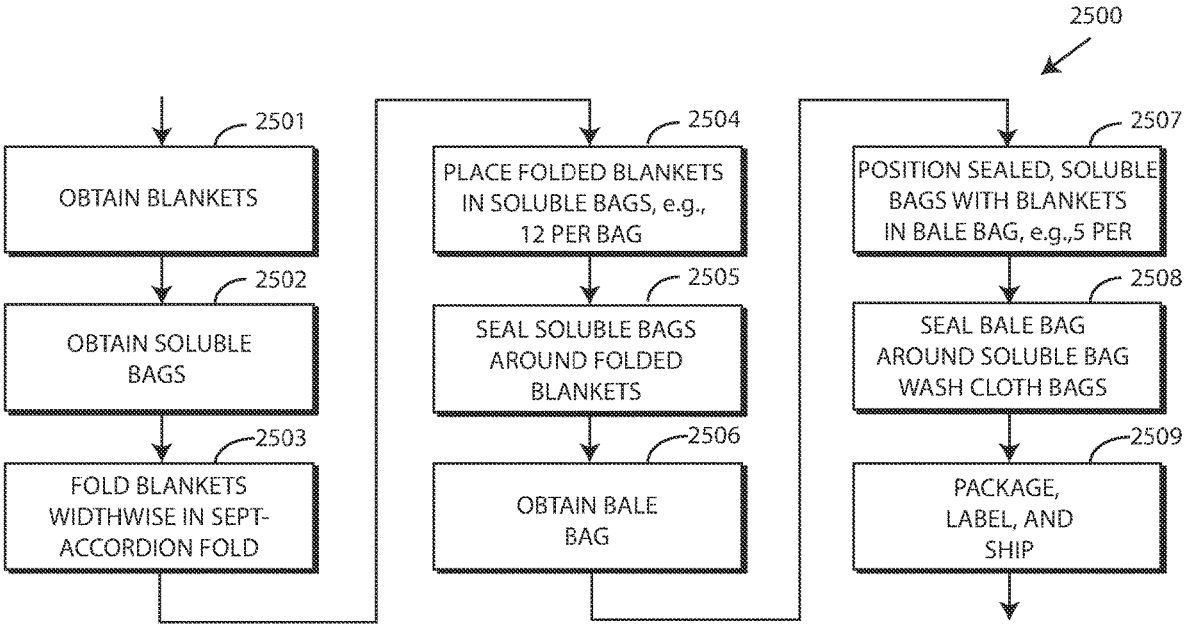
FIG. 25 illustrates another explanatory method in accordance with one or more embodiments of the disclosure.

Turning now to FIG. 25, illustrated therein is one explanatory method 2500 summarizing the steps depicted in FIGS. 18-24. Beginning at step 2501, a plurality of textile items is obtained. In one or more embodiments, these textile items comprise flat sheets. However, the textile items could take other forms as well, as noted above.

At step 2502, one or more dissolvable packages are obtained. At step 2503, the flat sheets obtained at step 2501 are folded with a wash enabled self-unfolding fold. In one or more embodiments, the wash enabled self-unfolding fold comprises an accordion fold that is first applied to the flat sheet, followed by a book fold. In one or more embodiments, the accordion fold is a "sept" accordion fold creating seven panels separated by sixe folds. In one or more embodiments, the book fold folds a first half of a partially folded flat sheet about a medial line such that a surface of the first half abuts a surface of a second half of the partially folded flat sheet.

In other embodiments, the wash enabled self-unfolding fold applied at step 2503 is formed using multiple accordion folds arranged in two different directions across the bath blanket. These multiple accordion folds can be trifolds, quad-folds, or other types of folds.

In still other embodiments, the wash enabled self-unfolding fold applied at step 2503 is formed by folding multiple bath blankets together, with an accordion fold, an interlocking fold, or otherwise. In still other embodiments, the wash enabled self-unfolding fold formed at step 2503 is a rolled fold. Other examples of wash enabled self-unfolding folds suitable for application at step 2503 will be obvious to those of ordinary skill in the art having the benefit of this disclosure.

At step 2504, folded flat sheets are placed into the dissolvable packages obtained at step 2502. In one or more embodiments, this placement occurring at step 2504 comprises placing twelve folded flat sheets in each dissolvable package.

At step 2505, the dissolvable packages are sealed around the textile items so as to completely and fully enclose the textile items situated therein. In one or more embodiments, step 2505 comprises sealing the dissolvable packages adhesively, although other sealing techniques can be used in other embodiments as noted above.

At step 2506, a bale bag is obtained. At step 2507, the kits defined by the sealed dissolvable packages with the textile items situated therein are arranged in a kit arrangement. Where the textile items comprise folded flat sheets such as that shown in FIG. 21, with those folded flat sheets stacked in stacks of twelve in each kit, step 2507 can comprise constructing a kit arrangement having one column of five kits in the kit arrangement.

The bale bag can then be sealed at step 2508. In one or more embodiments, step 2508 comprises sealing the bale bag adhesively, although other sealing techniques can be used in other embodiments as noted above. Step 1709 can comprise packaging and labeling the resulting bale. Step 2509 can also comprise shipping the bale to a laundry. As noted above, to launder the folded flat sheets, the laundry technician need only open the bale bag and deposit one or more kits in the laundry machine. The kit takes care of depositing the folded flat sheets situated therein into the wash water by dissolution. This also causes each folded flat sheet to automatically unfold. The use of the dissolvable package eliminates waste, saves time, and reduces the amount of labor required to wash the bath blankets in each kit. Twelve folded flat sheets can be washed as a single unit rather than requiring twelve separate retrieval, shaking, and deposit operations.

Figure 26:
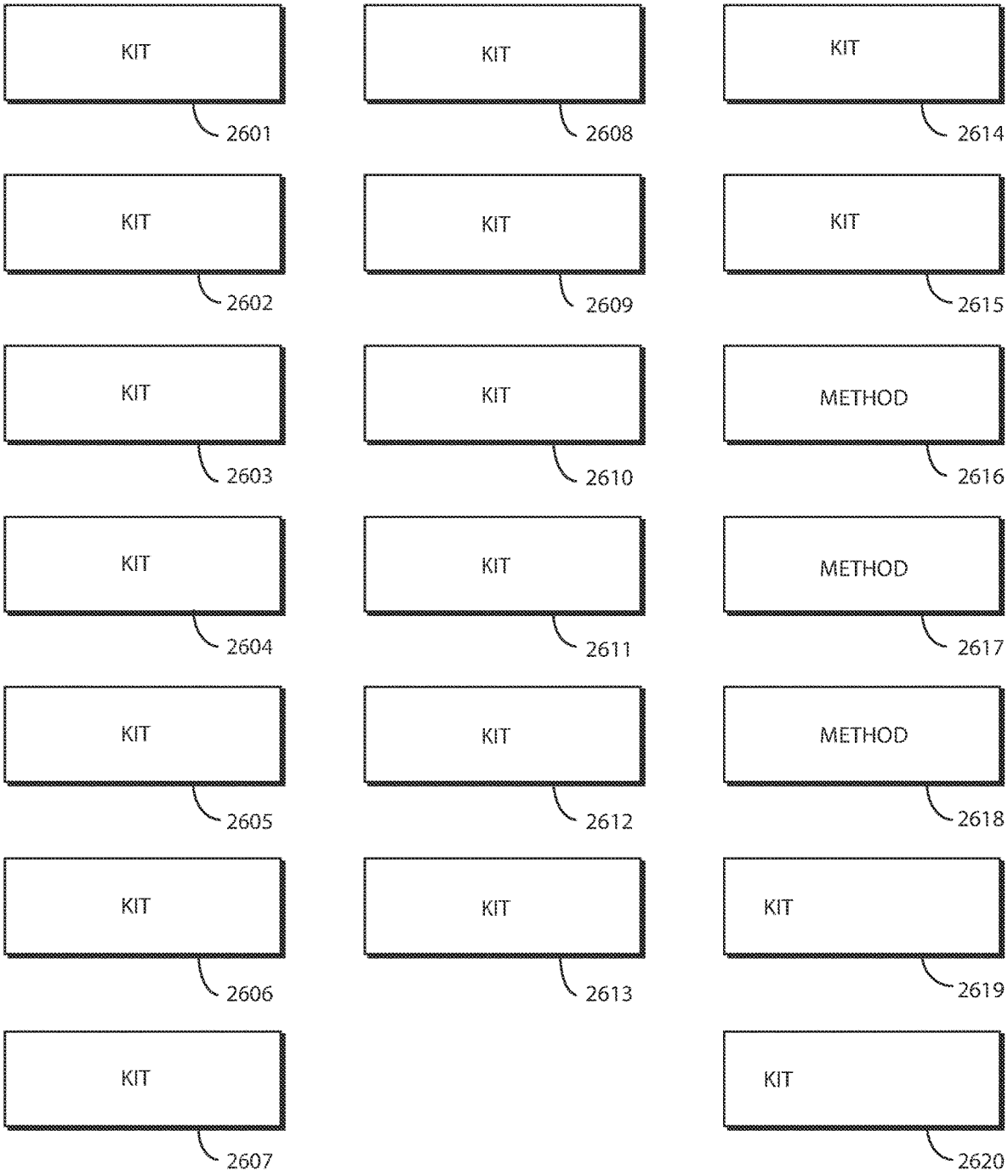
FIG. 26 illustrates various embodiments of the disclosure.

Turning now to FIG. 26, illustrated therein are various embodiments of the disclosure. The embodiments of FIG. 26 are shown as labeled boxes in FIG. 26 due to the fact that the individual components of these embodiments have been illustrated in detail in FIGS. 1-25, which precede FIG. 26. Accordingly, since these items have previously been illustrated and described, their repeated illustration is no longer essential for a proper understanding of these embodiments. Thus, the embodiments are shown as labeled.

At 2601, a kit comprises a plurality of textile items arranged in a stack. At 2601, the kit comprises a dissolvable package enclosing the plurality of textile items.

At 2602, the plurality of textile items of 2601 is folded with a wash enabled self-unfolding fold. At 2603, the wash enabled self-unfolding fold of 2602 comprises an accordion fold.

At 2604, the accordion fold of 2603 comprises a quad accordion fold. At 2605, the accordion fold of 2603 comprises a sept accordion fold.

At 2606, the wash enabled self-unfolding fold of 2603 comprises a book fold. At 2607, the accordion fold of 2606 is applied to each textile item of the plurality of textile items prior to the book fold.

At 2608, the dissolvable package of 2607 is adhesively sealed about the plurality of textile items. At 2609, the plurality of textile items of 2608 comprises a plurality of bath blankets. At 2610, the plurality of textile items of 2608 comprises a plurality of washcloths. At 2611, the plurality of textile items of 2608 comprises a plurality of flat sheets.

At 2612, a method comprises stacking a plurality of textile items in a dissolvable package. At 2612, the method comprises sealing the dissolvable package around the plurality of textile items to form a kit.

At 2613, the method of 2612 further comprises applying a wash enabled self-unfolding fold to each textile item of the plurality of textile items prior to stacking the plurality of textile items in the dissolvable package. At 2614, the applying the wash enabled self-unfolding fold of 2613 comprises first applying an accordion fold to the textile items to create partially folded textile items. At 2614, the applying the wash enabled self-unfolding fold of 2613 comprises then applying a book fold to the textile items to create folded textile items.

At 2615, the method of 2613 further comprises arranging the kit with at least one other kit to define a kit arrangement. At 2616, the method of 2615 further comprises positioning the kit arrangement in a bale bag and sealing the bale bag. At 2617, the textile items of 2612 are soiled.

At 2618, a kit arrangement comprises a kit comprising a plurality of textile items folded with a wash enabled self-unfolding fold and arranged in a stack within a sealed dissolvable package. At 2618, the kit arrangement comprises at least one other kit comprising at least one other plurality of textile items folded with at least one other wash enabled self-unfolding fold and arranged in at least one other stack within at least one sealed dissolvable package.

At 2619, the at least one other kit of 2618 comprises four kits arranged in a single column with the kit. At 2620, the kit arrangement of 2619 further comprises a sealed bale bag enclosing the kit arrangement.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims.

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

What is claimed is:

1. A kit, comprising:

a plurality of textile items arranged in a stack folded with a wash enabled self-unfolding fold; and a dissolvable package enclosing the plurality of textile items.

2. The kit of claim 1, the plurality of textile items each comprising a two-sided sheet of textile material.

3. The kit of claim 1, the wash enabled self-unfolding fold comprising an accordion fold.

4. The kit of claim 3, the accordion fold comprising a quad accordion fold.

5. The kit of claim 3, the accordion fold comprising a sept accordion fold.

6. The kit of claim 3, the wash enabled self-unfolding fold further comprising a book fold.

7. The kit of claim 6, wherein the accordion fold is applied to each textile item of the plurality of textile items prior to the book fold.

8. The kit of claim 7, the dissolvable package adhesively sealed about the plurality of textile items.

9. The kit of claim 8, the plurality of textile items comprising a plurality of bath blankets.

10. The kit of claim 8, the plurality of textile items comprising a plurality of washcloths.

11. The kit of claim 8, the plurality of textile items comprising a plurality of flat sheets.

12. A method, comprising:

stacking a plurality of textile items in a dissolvable package;

sealing the dissolvable package around the plurality of textile items to form a kit; and applying a wash enabled self-unfolding fold to each textile item of the plurality of textile items prior to stacking the plurality of textile items in the dissolvable package.

13. The method of claim 12, further comprising arranging the kit with at least one other kit in a bale.

14. The method of claim 12, the applying the wash enabled self-unfolding fold comprising:

first applying an accordion fold to the plurality of textile items to create a plurality of partially folded textile items; and then applying a book fold to the plurality of partially folded textile items to create a plurality of folded textile items.

15. The method of claim 12, further comprising arranging the kit with at least one other kit to define a kit arrangement.

16. The method of claim 15, further comprising positioning the kit arrangement in a bale bag and sealing the bale bag.

17. The method of claim 12, wherein the textile items are soiled.

18. A kit arrangement, comprising:

a kit comprising a plurality of textile items folded with a wash enabled self-unfolding fold and arranged in a stack within a sealed dissolvable package; and at least one other kit comprising at least one other plurality of textile items folded with at least one other wash enabled self-unfolding fold and arranged in at least one other stack within at least one sealed dissolvable package.

19. The kit arrangement of claim 18, wherein the at least one other kit comprises four kits arranged in a single column with the kit.

20. The kit arrangement of claim 19, further comprising a sealed bale bag enclosing the kit arrangement.

* * * * *